US008121530B2

(12) United States Patent
Takiguchi et al.

(10) Patent No.: US 8,121,530 B2
(45) Date of Patent: Feb. 21, 2012

(54) IMAGE FORMING METHOD AND IMAGE FORMING APPARATUS

(75) Inventors: Toshiki Takiguchi, Yamatokoriyama (JP); Hiroyuki Murai, Yamatokoriyama (JP); Masato Kuze, Yamatokoriyama (JP); Yuji Kumagai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/023,779

(22) Filed: Feb. 9, 2011

(65) Prior Publication Data

US 2011/0135327 A1 Jun. 9, 2011

Related U.S. Application Data

(62) Division of application No. 11/854,581, filed on Sep. 13, 2007, now Pat. No. 7,957,688.

(30) Foreign Application Priority Data

Sep. 21, 2006 (JP) ..... 2006-256437
Sep. 21, 2006 (JP) ..... 2006-256438

(51) Int. Cl.
*G03G 15/00* (2006.01)

(52) U.S. Cl. ..... 399/388; 399/398

(58) Field of Classification Search ..... 399/388
See application file for complete search history.

(56) References Cited

U.S. PATENT DOCUMENTS 4,945,386 A 7/1990 Ito et al.
5,104,111 A * 4/1992 Matsuda ..... 271/110
5,291,228 A 3/1994 Tetsuya et al.
5,502,545 A 3/1996 Tsuruoka
5,609,333 A 3/1997 Mandel et al.
5,622,364 A * 4/1997 Dutton et al. ..... 271/117
5,839,015 A 11/1998 Faguy et al.
6,619,655 B2 9/2003 Müller et al.
6,625,561 B1 9/2003 Tullis
6,724,506 B1 * 4/2004 Wang ..... 358/498

(Continued)

FOREIGN PATENT DOCUMENTS

JP 4-293071 A 10/1992

(Continued)

OTHER PUBLICATIONS

Co-pending U.S. Appl. No. 11/854,581, filed Sep. 13, 2007 (current claims provided).

*Primary Examiner* — Anthony Nguyen
(74) *Attorney, Agent, or Firm* — Renner, Otto, Boisselle & Sklar, LLP

(57) ABSTRACT

In an image forming method, an electrostatic latent image formed on a surface of a photoreceptor is developed into a developer image with a developer, and a printing paper transported on a transfer belt is brought into contact with the surface of the photoreceptor so as to transfer the developer image onto the printing paper. The printing paper is transported in a proper transport direction, in which a projection generated in one direction on the printing paper as a result of cutting the printing paper in a printing paper manufacturing process does not face a surface of the transfer belt at a leading edge of the printing paper being transported on the transfer belt. In this way, even in the presence of the projection generated when the printing paper is cut, the printing paper naturally strips off from the surface of the photoreceptor, thereby preventing toner contamination caused by a striping claw in contact with the leading edge of the printing paper.

8 Claims, 15 Drawing Sheets

U.S. PATENT DOCUMENTS

| | | | | |
|---|---|---|---|---|
| 7,248,809 | B2 | 7/2007 | Kim et al. | |
| 7,458,570 | B2 * | 12/2008 | Ueda et al. | 271/97 |
| 2002/0060393 | A1 | 5/2002 | Muller et al. | |
| 2005/0184443 | A1 | 8/2005 | Satoh et al. | |

FOREIGN PATENT DOCUMENTS

| | | |
|---|---|---|
| JP | 07-309479 | 11/1995 |
| JP | 2002-211817 | 7/2002 |
| JP | 2002-211834 | 7/2002 |

* cited by examiner

IMAGE FORMING METHOD AND IMAGE FORMING APPARATUS

This application is a divisional application of U.S. application Ser. No. 11/854,581 filed on Sep. 13, 2007 now U.S. Pat. No. 7,957,688 which claims priority to Japanese Application Nos. 2006-256437 and 2006-256438 both filed on Sep. 21, 2006, the contents of which are hereby incorporated by reference.

This Nonprovisional application claims priority under 35 U.S.C. §119(a) on Patent Application No. 2006-256437 filed in Japan on Sep. 21, 2006, and No. 2006-256438 filed in Japan on Sep. 21, 2006, the entire contents of which are hereby incorporated by reference.

FIELD OF THE INVENTION

The present invention relates to an image forming method including a transfer step in which a toner image formed on a photoreceptor is transferred onto a printing paper, and an image forming apparatus in which a printing paper is transported from a paper feed cassette and a toner image formed on the photoreceptor is transferred onto the printing paper.

BACKGROUND OF THE INVENTION

In image forming apparatuses such as copying machines and printers, the processing speed constitutes an important factor that determines the performance of the apparatus. In this regard, developments have been made to meet the demand for faster processing speed. For example, the print processing capability of "high-speed machines" has rapidly increased to 100 to 120 sheets/minute (A4-size paper, lateral feed) as compared with 50 to 70 sheets/minute (A4-size paper, lateral feed) only a few years ago. Under these circumstances, the applicable areas of such high-speed machines, from the standpoint of processing speed, now include near-printing, outside the domain of the image forming apparatus. It is therefore necessary in such high-speed image forming apparatuses to stably transport printing paper at high speed while ensuring good print quality.

In conventional image forming apparatuses, the transfer belt system has been pervasive as the system suited for high-speed processing. In image forming apparatuses adapting the transfer belt system, a printing paper electrostatically attracted to a surface of a transfer belt is transported so that a toner image formed on a surface of a photoreceptor is transferred onto the printing paper, as described in Patent Publication 1. The printing paper on the transfer belt is then sent to a fixing device, where the toner image on the printing paper is fixed thereon.

Patent Publication 1

Japanese Laid-Open Patent Publication No. 309479/1995 (Tokukaihei 7-309479, published on Nov. 28, 1995)

In a transfer step in which the toner image on the surface of the photoreceptor is transferred to the printing paper, the printing paper easily sticks to the surface of the photoreceptor. This is caused by the charge on the printing paper, which is generated by the friction with various rollers transporting the printing paper, or by the transfer electric field which accumulates on the printing paper in the transfer step, among other things.

As a countermeasure, the image forming apparatus is provided with a stripping claw that forcibly strips the printing paper from the surface of the photoreceptor. In this way, a paper jam is prevented that occurs around the photoreceptor when the printing paper does not naturally strips from the surface of the photoreceptor.

Meanwhile, the image forming apparatus is designed so that the printing paper naturally strips from the surface of the photoreceptor, not forcibly with the stripping claw, taking into account such factors as the tendency of the charged printing paper to stick to the surface of the photoreceptor, the stiffness of the printing paper, the curvature of the photoreceptor, and the transport speed of the printing paper, for example. This is to prevent the stripping claw from contaminating a leading edge of the printing paper.

Specifically, in order to strip the printing paper from the surface of the photoreceptor, the stripping claw is disposed with its front end in contact with the surface of the photoreceptor. Owning to this configuration, the toner remaining on the surface of the photoreceptor easily adheres to the front end of the stripping claw. When the leading edge of printing paper is brought into contact with the front end of the stripping claw, the toner adhering to the stripping claw adheres to the leading edge of printing paper and contaminates the printing paper. Such contamination at the leading edge of the printing paper caused by the contact with the stripping claw can be avoided by naturally stripping the printing paper from the surface of the photoreceptor, not forcibly with the striping claw. The stripping claw is therefore provided as assisting means for forcibly stripping the printing paper from the surface of the photoreceptor, when the printing paper does not naturally strips.

However, despite the design that allows the printing paper to naturally strips from the surface of the photoreceptor, toner contamination occurs frequently by the contact between the leading edge of the printing paper and the stripping claw. This leads to deterioration of printed image quality as seen in conventional image forming apparatuses.

It is accordingly an object of the present invention to provide an image forming method and image forming apparatus that enable the printing paper to be naturally stripped off from the surface of the photoreceptor without relying on the stripping claw, even when the printing paper has a projection generated when it is cut, and that therefore prevent toner contamination caused by the contact between the leading edge of the printing paper and the stripping claw.

SUMMARY OF THE INVENTION

The inventors of the present invention made an assessment as to the cause of toner contamination that occurs at the leading edge of many printing papers when the printing paper does not naturally strips off from the surface of the photoreceptor as intended by the design that takes into account the tendency of charged printing paper to stick to the surface of the photoreceptor, the stiffness of the printing paper, the curvature of the photoreceptor, and the transport speed of the printing paper, etc. After extensive study, the inventors found what was causing toner contamination at the leading edge of many printing papers, and the solution to this problem.

Specifically, the printing papers used for the image forming apparatus are made out of a large sheet of printing paper manufactured in a paper factory, where the large sheet is cut into sheets of various standard sizes with cutters before they are packaged and shipped. The printing papers of various standard sizes therefore have cutting surfaces (edges) where projections are formed in the direction of cut.

For example, in a paper factory, a large sheet of printing paper is first cut into strips of a specific width (length), and each strip of printing paper is cut into printing papers of a specific length (width) with a vertically moving cutter. The vertically moving cutter is generally single-edged, and in this case the projection occurs only on one side of the printing paper. When the vertically moving cutter is double-edged, the projection occurs on both sides of the printing paper. The projection is small but the presence or absence or the direction of the projection can be recognized by touching it with a finger.

When the printing paper stored in a paper feeding section (paper feed cassette) of the image forming apparatus and transported therefrom between a transport belt and the photoreceptor has the projection at the leading edge, a gap is created between the leading edge of the printing paper and the transport belt, if the projection faces the transport belt.

In this case, a continuous discharge occurs between the leading edge of the printing paper and the transport belt according to Paschen's law. As a result, the potential on the transport belt side of the printing paper decreases, and this is accompanied by a relative potential increase on the photoreceptor side of the printing paper. This increases the attracting force between the printing paper and the photoreceptor, relative to that between the printing paper and the transport belt. In this case, the printing paper will not naturally strip from the surface of the photoreceptor and remains adhered to the surface of the photoreceptor. This necessitates the stripping claw to forcibly strip the printing paper from the surface of the photoreceptor, with the result that toner contamination occurs at the leading edge of the printing paper. It is therefore necessary that no gap be formed between the leading edge of the printing paper and the transport belt.

The present invention provides the following arrangements in order to prevent toner contamination that occurs when the printing paper does not naturally strip from the surface of the photoreceptor by the presence of the projection and the stripping claw is brought into contact with the leading edge of printing paper.

The present invention provides an image forming method in which an electrostatic latent image formed on a surface of a photoreceptor is developed into a developer image with a developer, and in which a printing paper transported on a transport belt is brought into contact with the surface of the photoreceptor so as to transfer the developer image onto the printing paper, the method including transporting the printing paper in a proper transport direction, in which a projection generated in one direction on the printing paper as a result of cutting the printing paper in a printing paper manufacturing process does not face a surface of the transport belt at a leading edge of the printing paper being transported on the transport belt.

According to this arrangement, the printing paper is transported such that the projection does not face the surface of the transport belt at the leading edge of the printing paper being transported. That is, the projection, which may be present at the leading edge of the printing paper being transported, does not face the transport belt. Accordingly, the projection does not create a gap between the leading edge of the printing paper and the transport belt. The absence of the gap means there is no discharge that causes a potential drop on the transport belt side of the printing paper and no relative increase in the attracting force between the printing paper and the photoreceptor. This ensures that the printing paper is naturally stripped from the surface of the photoreceptor. There accordingly will be no toner contamination caused by the contact between the leading edge of the printing paper and the stripping claw.

The present invention provides an image forming apparatus in which an electrostatic latent image formed on a surface of a photoreceptor is developed into a developer image with a developer, and in which a printing paper sent out from a paper feeding section and transported on a transport belt is brought into contact with the surface of the photoreceptor to transfer the developer image onto the printing paper, the image forming apparatus including: a load height detecting section for detecting a height of a printing paper bundle loaded in the paper feeding section, both at a front end portion and a rear end portion with respect to a direction of ejection of the printing paper from the paper feeding section; a placement direction determining section for determining a current placement direction of the printing paper bundle from a result of detection of the load height detecting section, the current placement direction indicative of whether a projection generated in one direction on the printing paper as a result of cutting the printing paper in a printing paper manufacturing process is present on which of the front end portion and the rear end portion of the printing paper bundle with respect to the direction of ejection; and a warning section for comparing the current placement direction with a proper placement direction, which a direction set for the printing paper bundle in the paper feeding section to transport the printing paper in such a manner that the projection does not face a surface of the transport belt at a leading edge of the printing paper being transported, and when the current placement direction and the proper placement direction do not match, giving a warning to a user of the image forming apparatus.

According to this arrangement, the placement direction determining section determines a current placement direction of the printing paper bundle from a result of detection of the load height detecting section, the current placement direction indicative of whether a projection generated in one direction on the printing paper is present on which of the front end portion and the rear end portion of the printing paper bundle with respect to the direction of ejection. The warning section compares the current placement direction with a proper placement direction, which is a direction set for the printing paper bundle in the paper feeding section so that the printing paper is transported with the projection not facing a surface of the transport belt at a leading edge of the printing paper being transported, and when the current placement direction and the proper placement direction do not match, gives a warning to a user of the image forming apparatus. By following the warning, the user of the apparatus is able to change the displacement direction of the printing paper bundle in such a manner that the current displacement direction of the printing paper bundle in the paper feeding section matches the proper displacement direction.

When the printing paper bundle is placed in the proper placement direction in the paper feeding section, the printing paper from the paper feeding section is transported in such a manner that the projection does not face the surface of the transport belt at the leading edge of the printing paper being transported. That is, the projection, which may be present at the leading edge of the printing paper being transported, does not face the transport belt. Accordingly, the projection does not create a gap between the leading edge of the printing paper and the transport belt. The absence of the gap means there is no discharge that causes a potential drop on the transport belt side of the printing paper and no relative increase in the attracting force between the printing paper and the photoreceptor. This ensures that the printing paper is naturally stripped from the surface of the photoreceptor. There accordingly will be no toner contamination caused by the contact between the leading edge of the printing paper and the stripping claw.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 6(*b*) is a perspective view of a step in which each rolled paper is cut into printing papers of a specific size; and FIG. 6(*c*) is an explanatory diagram showing a step in which the printing papers of a specific size are gathered at one place.

FIG. 7(*b*) is a longitudinal section showing how a projection is generated at an edge of the printing paper cut with the second cutter.

DESCRIPTION OF THE EMBODIMENTS

The following will describe one embodiment of the present invention with reference to the attached drawings.

Figure 2:
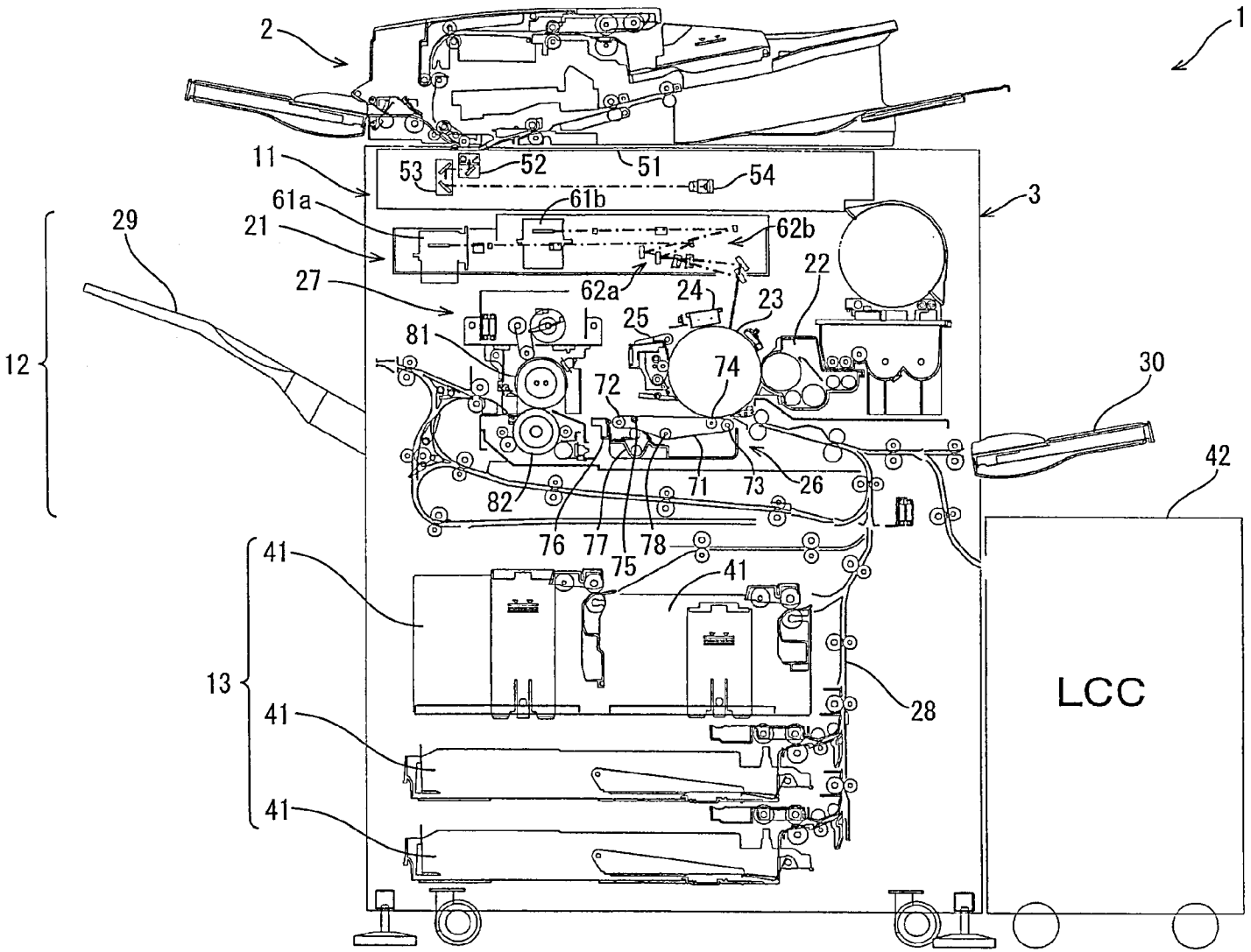
FIG. 2 is an explanatory diagram schematizing a whole structure of a multi-functional apparatus provided with the image forming apparatus according to one embodiment of the present invention.

FIG. 2 is an explanatory diagram schematically showing a whole structure of a multi-functional apparatus 1 provided with an image forming apparatus of the present embodiment. The multi-functional apparatus 1 includes a document feeder (hereinafter, "SPF": Single Pass Feeder) 2, and an image forming apparatus 3.

The image forming apparatus 3 forms a monochromatic image on a printing paper (sheet) according to image data obtained by scanning a document that has been transported with the SPF 2, or externally inputted image data. The image forming apparatus 3 includes a scanner section (document reading device) 11, a printer section 12, and a paper feeding section 13.

The printer section 12 includes an optical write-in unit 21, a developing unit 22, a photoreceptor 23, a charger 24, a cleaner unit 25, a transfer unit 26, a fixing unit 27, a paper transport path 28, an eject tray 29, and a manual feed tray 30. The paper feeding section 13 includes paper feed cassettes 41 and a large-capacity paper feed cassette (LCC) 42. The paper feed cassettes 41 and the large-capacity paper feed cassette 42 store printing papers to be used for image formation.

The scanner section 11 on its upper portion includes a document platen 51 made of glass, below which a light-source holder 52, a set of mirrors 53, and a CCD (imaging device) 54 are provided. In scanning a document sent from the SPF 2, the scanner section 11 holds the light-source holder 52 and the set of mirrors 53 at one end of the document platen 51. In response to the document from the SPF 1, a light source of the light-source holder 52 projects light on the document, and the reflected light from the document is converged via the set of mirrors 53 on the COD 54, which then converts the light into electrical image data. For this operation, a scan window is formed at one end on the upper surface of the scanner section 11. In the printer section 12, the charger 24 uniformly charges a surface of the photoreceptor 23 to a predetermined potential. The image forming apparatus 3 uses the charger 24 of an electrostatic charging type, but the charge 24 may be of a contact roller-type or a contact brush-type.

To accommodate the high-speed print process, the optical write-in unit 21 employs a two-beam method using two laser irradiating sections 61*a* and 61*b*, which ease the burden of short irradiation timings. The optical write-in unit 21 causes the laser irradiating sections 61*a* and 61*b* to emit laser beams according to inputted image data. Via a set of mirrors 62*a* and 62*b*, the laser beams irradiate and expose the photoreceptor 23 that has been uniformly charged. As a result, an electrostatic latent image according to the image data is formed on the surface of the photoreceptor 23.

In the image forming apparatus 3, the optical write-in unit 21 is realized by a laser scanning unit (LSU) equipped with the laser irradiating sections 61*a*, 61*b* and the set of mirrors 62*a* and 62*b*. However, an EL or LED write head may be used in which light-emitting elements are disposed in an array.

The developing unit 22 is disposed to face the photoreceptor 23, and visualizes the electrostatic latent image formed on the surface of the photoreceptor 23, using black toner. The cleaner unit 25 removes and collects toner remaining on the surface of the photoreceptor 23 after development and image transfer.

The transfer unit 26 applies an electric field of the polarity opposite the charge of the electrostatic latent image, so that the toner image formed on the surface of the photoreceptor 23 is transferred onto the printing paper. For example, a positive (+) electric field is applied when the electrostatic latent image is negatively charged (−). The transfer unit 26 includes a transfer belt (transport belt) 71, a driving roller 72, a driven roller 73, and a transfer roller 74. The transfer roller 74 is provided at the point of contact between the photoreceptor 23 and the transfer belt 71, and applies a transfer electric field.

The transfer belt 71 has a resistance value in a range of $1\times10^{9}$ to $1\times10^{13}$ Ω·cm. The transfer roller 74 generates the electric field of this range so that the toner image formed on the photoreceptor 23 is transferred onto the printing paper. The transfer roller 74 is formed of an elastically supported conductive roller. By being elastic, the transfer roller 74 allows the photoreceptor 23 and the transfer belt 71 to be brought into contact with each other over an area, not a line, of a predetermined width (transfer nip). This improves transfer efficiency of the toner image onto the paper.

The transfer unit 26 further includes a charge-removing roller 75, a cleaning unit 76, a charge-removing mechanism 77, and a tension roller 78. The charge-removing roller 75 is provided on the downstream side of the transfer region, so that the charge of printing paper applied by the electric field in the transfer region is removed. In this way, the printing paper can be smoothly transported to the next step. The cleaning unit 76 removes toner contamination on the transfer belt 71. The charge-removing mechanism 77 removes charge from the transfer belt 71. The charge-removing mechanism 77 may remove charge by grounding, or by actively applying an electric field of the polarity opposite the polarity of the transfer electric field. The tension roller 78 applies tension to the transfer belt 71.

The fixing unit 27 fixes the transferred toner image on the printing paper by heating and fusing it. The fixing unit 27 includes a heat roller 81 and a pressure roller 82. The heat roller 81 has a heat source installed therein, and the pressure roller 82 is pressed against the heat roller 81 with a predetermined pressure.

Printing paper with a printed image is ejected onto the eject tray 29. Instead of the eject tray 29, devices for post-processing of the ejected paper (for example, stapling, punching), or eject trays of multiple stages may be optionally provided.

The paper feed cassettes 41 and the large-capacity paper feed cassette 42 are provided to store printing papers (sheets) used for image formation. For high-speed print processes, the paper feed cassette 41 disposed below the printer section 12 can store 500 to 1500 sheets of printing paper of each standard size. The large-capacity paper feed cassette 42 disposed outside of the cabinet of the image forming apparatus 3 can store large numbers of different kinds of printing paper. The manual feed tray 30 is provided to feed printing paper of a non-standard size.

Figure 3:
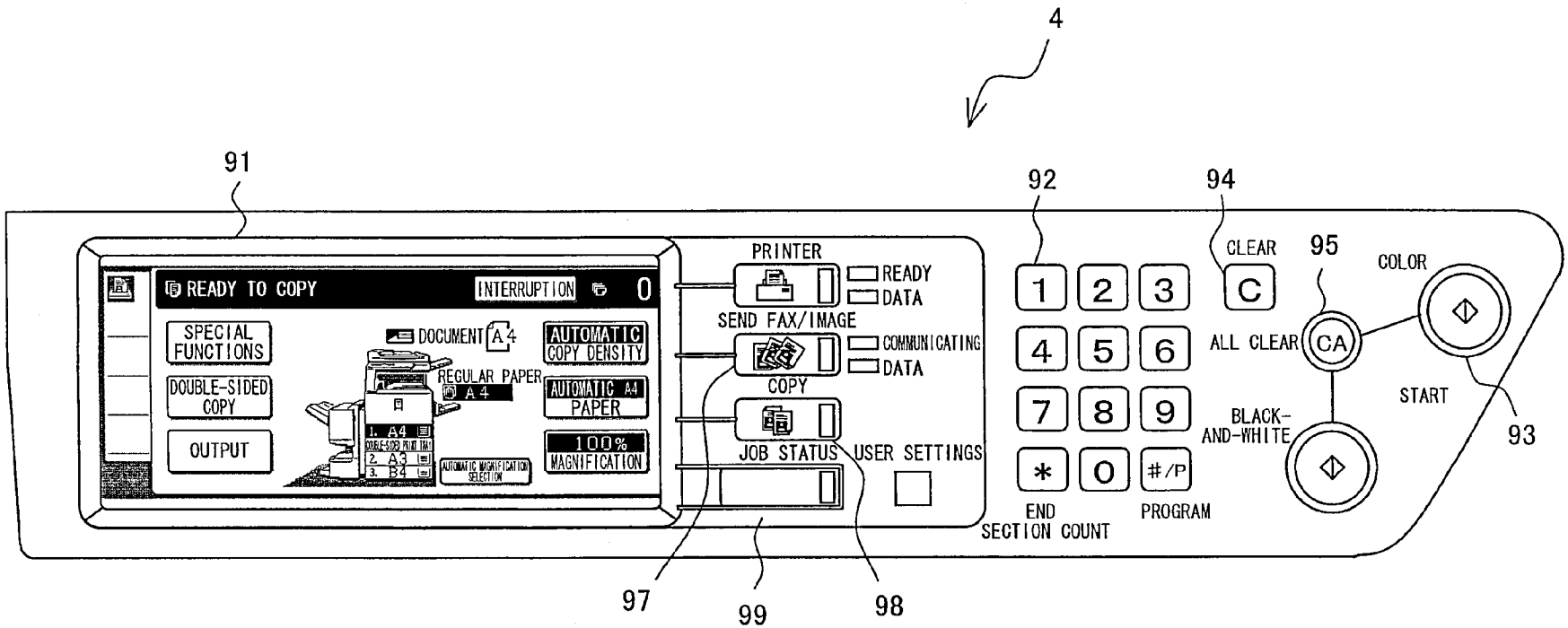
FIG. 3 is a front view of a touch-panel liquid crystal display provided in the multi-functional apparatus shown in FIG. 2.

As a user interface, the multi-functional apparatus 1 is provided with an operation panel 4. As shown in FIG. 3, the operation panel 4 includes a touch-panel liquid crystal display (hereinafter "LCD") 91, numeric keys 92, a start key 93, a clear key 94, a clear all key 95, a printer key 96, a facsimile/image send key 97, a copy key 98, and a job status confirmation key 99, among others.

In the following, description is made as to a stripping operation in the image forming apparatus 3, in which the printing paper is stripped from the photoreceptor 23 after the toner image formed on the surface of the photoreceptor 23 has been transferred onto the printing paper on the transfer belt 71.

Figure 1:
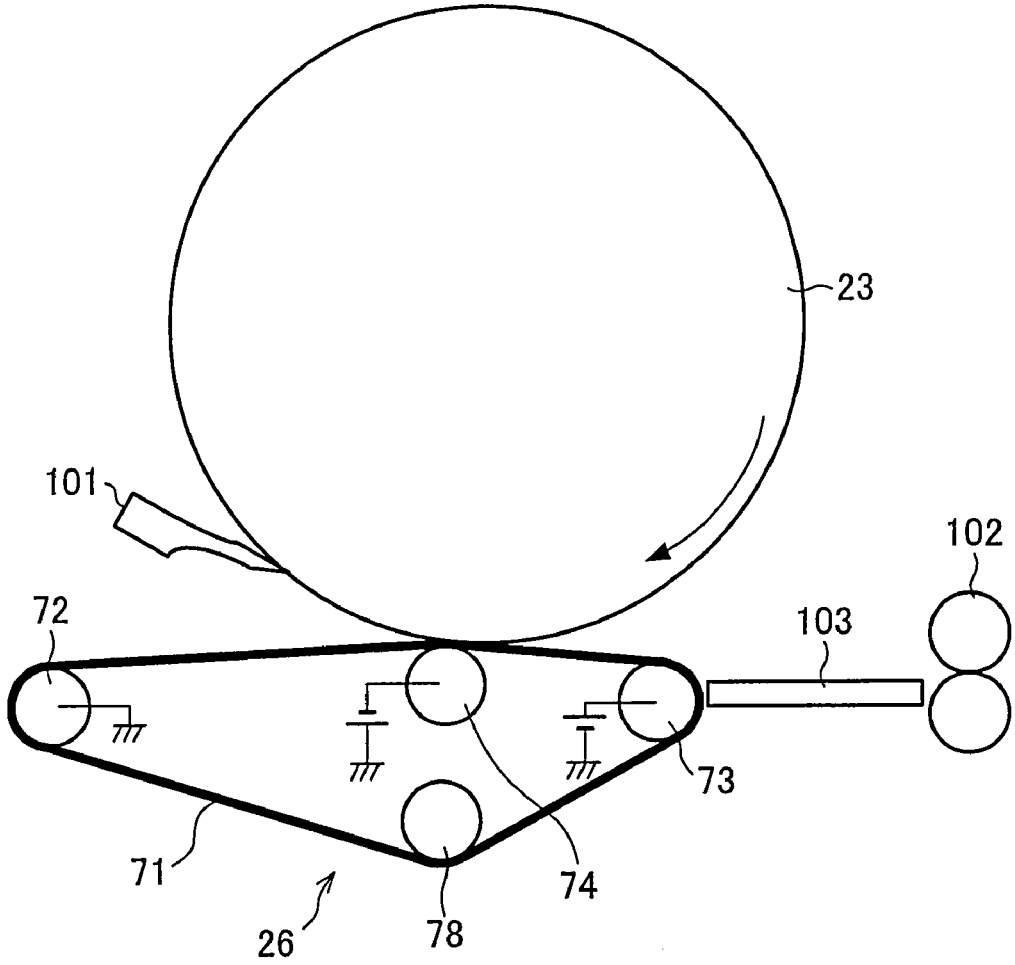
FIG. 1 is an explanatory diagram schematizing a structure of an image forming apparatus in the vicinity of a transfer unit and a photoreceptor, according to one embodiment of the present invention.

FIG. 1 is an explanatory diagram schematizing a structure in the vicinity of the transfer unit 26 and the photoreceptor 23 in the image forming apparatus 3 shown in FIG. 2. As diagramed, the driven roller 73 serves as a paper attracting roller which charges the transfer belt 71 to attract the printing paper, and the driving roller 72 serves as a paper stripping roller which removes the charge of the printing paper to facilitate stripping of the paper from the transfer belt 71. On the periphery of the photoreceptor 23, a stripping claw 101 is provided downstream of the nip area between the photoreceptor 23 and the transfer belt 71, with respect to the direction of transport of printing paper. The stripping claw 101 forcibly strips the printing paper adhering to the surface of the photoreceptor 23.

In FIG. 1, the printing paper is transported between the transfer belt 71 and the photoreceptor 23 by being carried on the transfer belt 71 of the transfer unit 26 via registration rollers 102 and a paper guide 103. The registration rollers 102 send out the paper at a predetermined timing that the toner image on the surface of the photoreceptor 23 aligns in position with the printing paper.

By the transfer electric field applied by the transfer roller 74, the toner image on the surface of the photoreceptor 23 is transferred onto the printing paper that has been transported to the nip area between the transfer belt 71 and the photoreceptor 23. By virtue of the charge generated by friction or electric field during transport, the printing paper has the tendency to be attracted to the surface of the photoreceptor 23. However, it is intended by design that the printing paper is naturally stripped before the leading edge of the paper reaches the stripping claw 101, taking into account influences of such factors as stiffness of printing paper, curvature of the photoreceptor, and transport speed of printing paper, or attracting electric field of the transfer belt 71.

Figure 4:
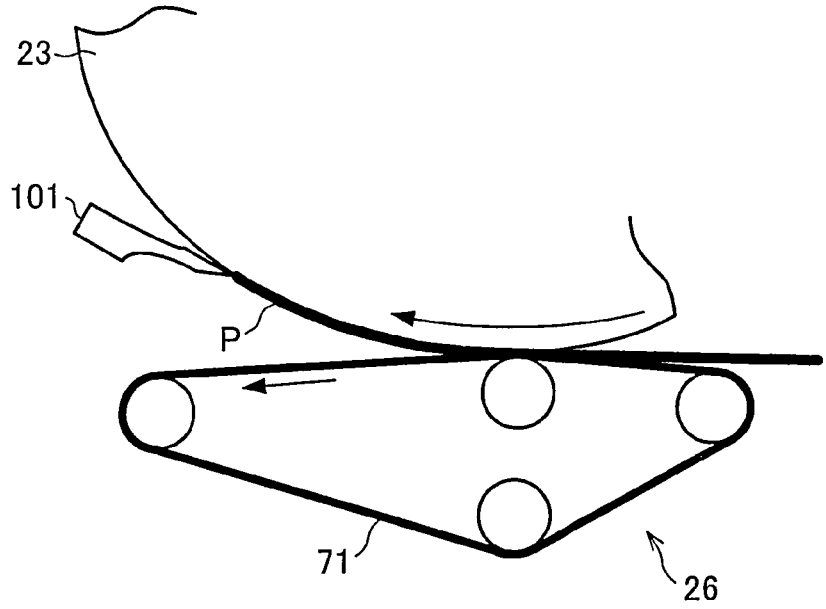
FIG. 4 is an explanatory diagram illustrating how a printing paper is forcibly stripped from a surface of the photoreceptor with a striping claw, when the printing paper does not naturally strips in the arrangement shown in FIG. 1.
Figure 5:
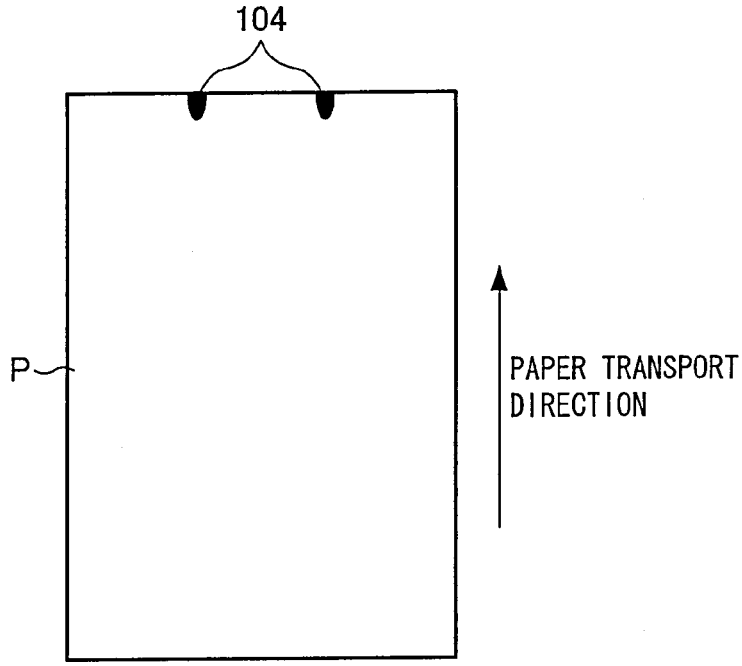
FIG. 5 is a front view of printing paper on which toner contamination has occurred at the leading edge by the forced stripping with the stripping claw shown in FIG. 4.

However, despite such design, the printing paper in actual practice does not always behave as intended. In some cases, the printing paper is naturally stripped from the surface of the photoreceptor 23. In other cases, as shown in FIG. 4, the printing paper does not strip naturally but the leading edge of printing paper P reaches the stripping claw 101 and is forcibly stripped. When forcibly stripped by the stripping claw 101, the toner adhering to the striping claw 101 is transferred to the leading edge of printing paper P and causes toner contamination 104, as shown in FIG. 5.

To investigate, occurrence of toner contamination 104 on printing paper was examined. As a result, certain patterns were observed in toner contamination 104 occurring in printing papers obtained from the same package. Table 1 below shows the result of investigation. In Table 1, Feed Example 1 and Feed Example 2 represent sheets of paper produced by different manufacturers. The papers in each example came from the same package.

TABLE 1

| Continuously Printed Papers | Feed Example 1 | Feed Example 2 |
|---|---|---|
| 1st paper | ○ | ○ |
| 2nd paper | ○ | x |
| 3rd paper | ○ | x |
| 4th paper | x | x |
| 5th paper | x | ○ |
| 6th paper | ○ | ○ |
| 7th paper | ○ | x |
| 8th paper | ○ | x |
| 9th paper | x | x |
| 10th paper | x | ○ |
| 11th paper | ○ | ○ |
| 12th paper | ○ | x |
| . | . | . |
| . | . | . |
| . | . | . |

○: No contamination; x: Contamination

Contamination at the leading edge of paper occurred according to the order of the papers loaded in a storage pack.

As can be seen from Table 1, Feed Example 1 followed the pattern that no contamination occurred in the first to third printing papers (○), and that contamination occurred in the fourth and fifth printing papers (x). Feed Example 2 followed the pattern that no contamination occurred in the first printing paper (○), contamination in the second to fourth printing papers (x), and no contamination in the fifth printing paper (○).

Then, comparisons were made between contaminated printing papers and non-contaminated printing papers. It was found as a result that the presence or absence of contamination was attributed to the direction of the projection on the cutting surface (edge) of the printing paper, and the direction of transport of the printing paper. The following describes this in detail.

Figure 6:
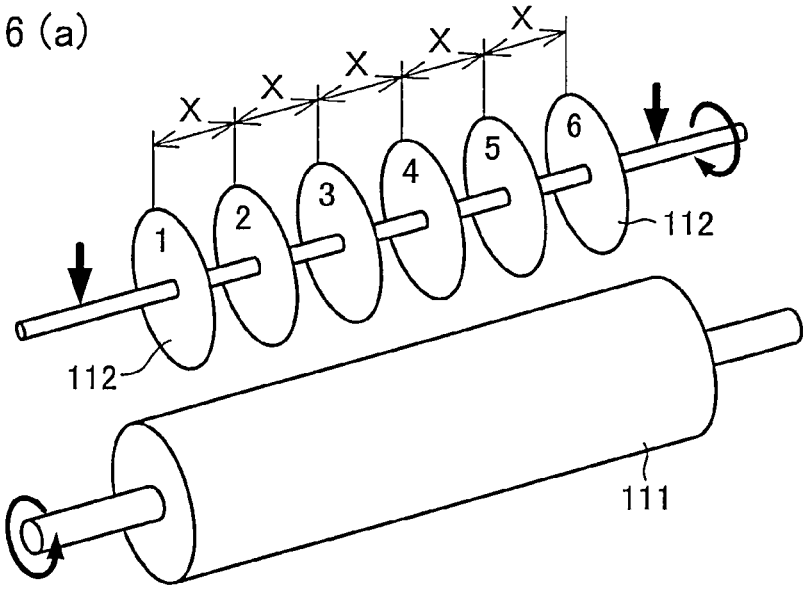
FIG. 6(*a*) is a perspective view of a step of cutting a rolled paper into printing papers of a specific size, illustrating how the rolled paper is cut into a plurality of roller papers of a specific width.
Figure 6:
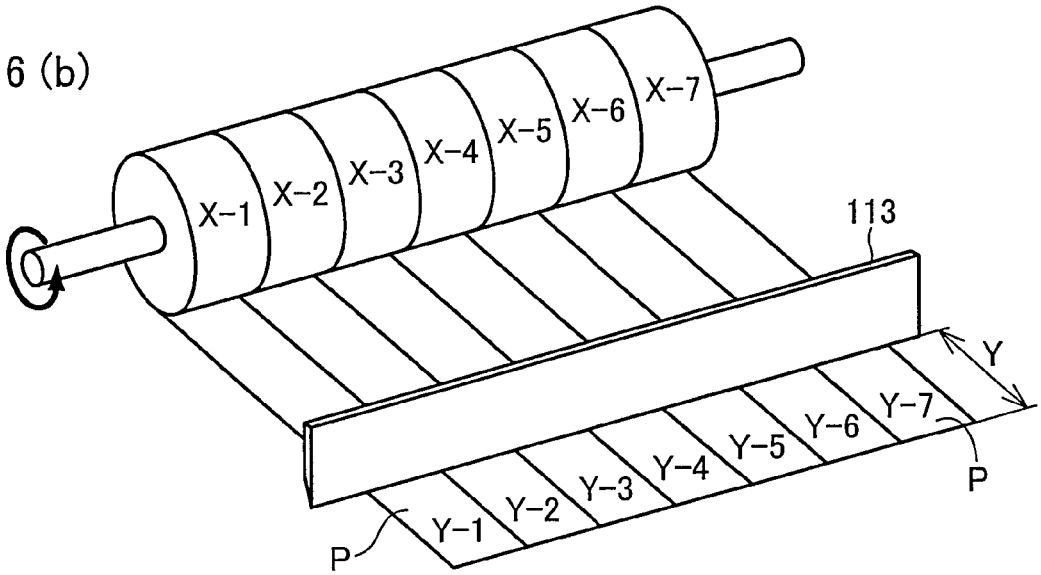
Figure 6:
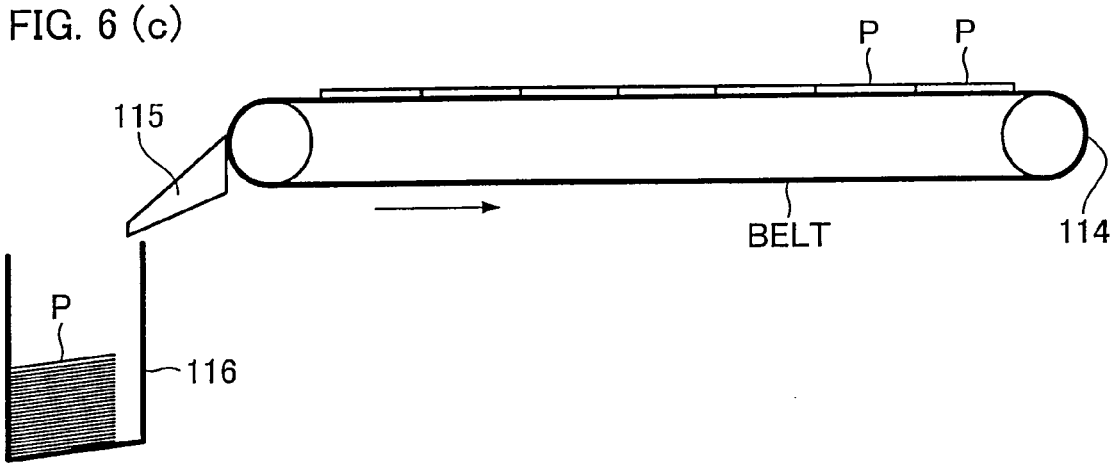

First, description is made as to how the projection is generated in a cutting step in the manufacture of the printing papers. FIG. 6 represents a step in which a large printing paper (a roll of paper) that has been produced in advance is cut into printing papers of a specific size. FIG. 6(*a*) is a perspective view showing a step in which a roll of paper is cut into smaller rolls of a specific width. FIG. 6(*b*) is a perspective view showing a step in which each roll of paper is cut into printing papers of a specific size. FIG. 6(*c*) is an explanatory diagram representing a step in which the printing papers of a specific size are organized and stacked together.

As shown in FIG. 6(*a*), a long and wide rolled paper 111 is cut into rolls of a specific width (or length) with a multiplicity of first cutters 112. As the first cutters 112, circular diamond cutters are used that rotate to cut the paper, for example. Next, as shown in FIG. 6(*b*), the rolls of paper are simultaneously cut into papers of a specific length (or width) with a single second cutter 113. As the second cutter 113, a guillotine cutter is used, for example. The second cutter 113 has a planar blade that moves up and down to cut the printing paper. Printing paper P of a specific size is then transported in one direction by the transport belt 151, and stacked on a paper stack section 116 by being guided with a paper navigating board 115. The printing papers in the paper stack section 116 are then packed into 500-sheet packages, for example.

Figure 7:
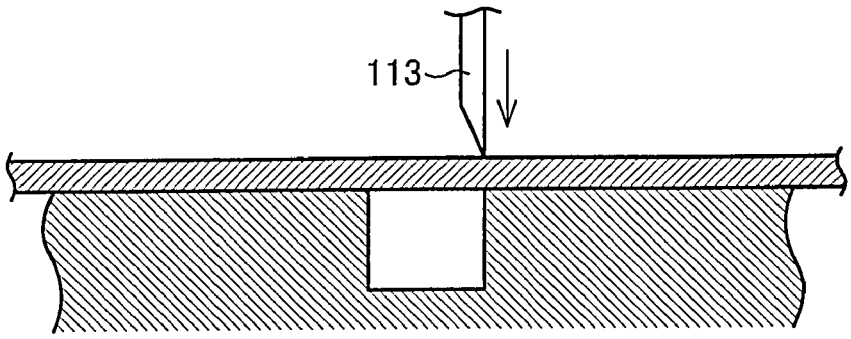
FIG. 7(*a*) is a longitudinal section showing a step in which a printing paper is cut with a second cutter shown in FIG. 6(*b*)
Figure 7:
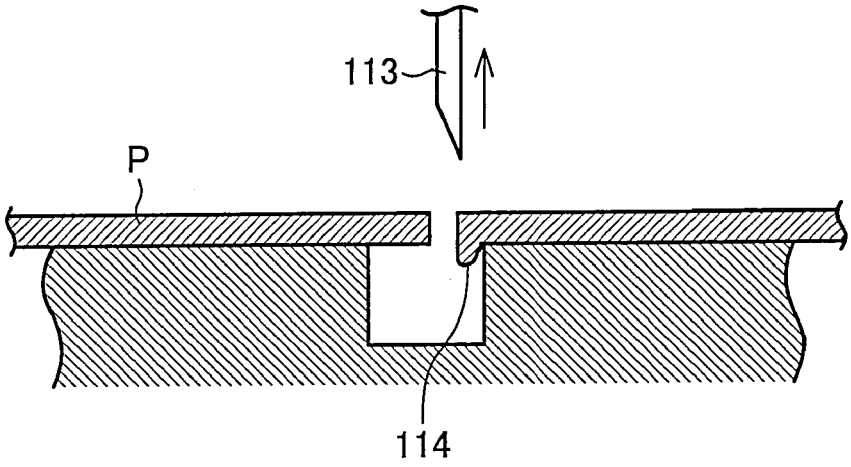
Figure 8:
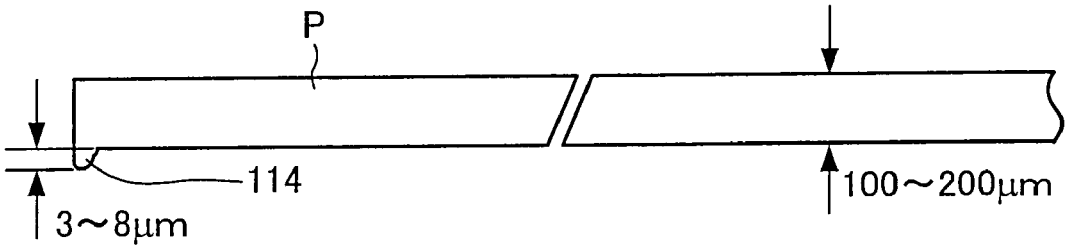
FIG. 8 is an explanatory diagram representing examples of dimensions for a thickness of the printing paper and a size of the projection shown in FIG. 7(*b*).

Here, when the first cutters 112 and the second cutter 113 are used to cut the printing paper, projections are generated, though to different extent, on the surface (edge) of the paper in the direction the paper is cut. FIG. 7 illustrates this. FIG. 7(*a*) is a longitudinal section showing a step in which the printing paper is cut with the second cutter 113, for example. FIG. 7(*b*) is a longitudinal section showing a state in which a projection 114 is generated at the edge of printing paper cut with the second cutter 113. The projection 114 shown in FIG. 7(*b*) has a height of, for example, 3 μm to 8 μm, when the printing paper P has a thickness of 100 μm to 200 μm, as shown in FIG. 8. The projection 114 is small (low) when the first cutters 112 and the second cutter 113 are sharp (desirable), and is large (high) when the first cutters 112 and the second cutter 113 are blunt.

The following will describe how the direction of transport of printing paper is related to the success and failure of natural stripping. Note that, the direction of transport of printing paper takes into account the position and direction of the projection 114.

Figure 9:
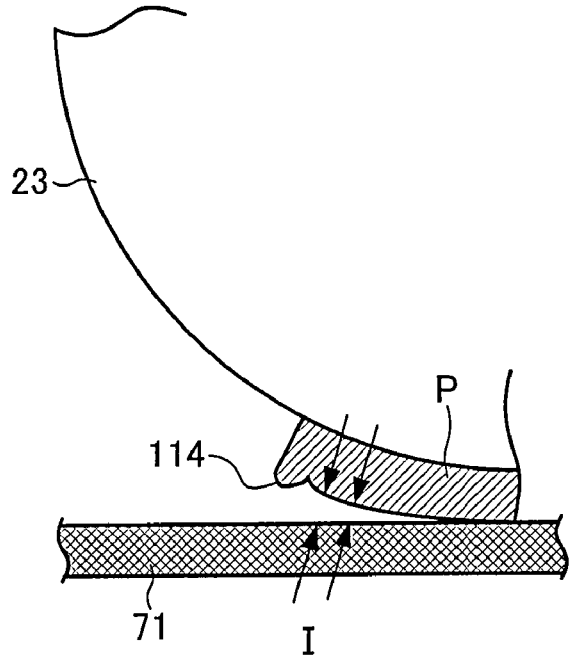
FIG. 9 is an explanatory diagram illustrating how the printing paper is striped from the surface of the photoreceptor when the printing paper is transported with the projection of FIG. 8 formed at the leading edge in the direction of transport of the printing paper and facing the transfer belt.

FIG. 9 is an explanatory diagram showing how the printing paper is stripped from the surface of the photoreceptor 23 when the projection 114 of the printing paper is at the leading edge of the printing paper being transported and when the projection 114 directs downward (faces the transfer belt 71).

When the printing paper is transported in the direction shown in FIG. 9, the upper surface of the printing paper will be in contact with the surface of the photoreceptor 23, whereas the lower surface of the printing paper is separated from the transfer belt 71 at the leading edge by a gap 117, which is created by the projection 114 at the leading edge of the printing paper. When the photoreceptor 23 rotates, this causes a continuous discharge according to Paschen's law between the leading edge of the printing paper and the transfer belt 71 (between opposing arrowheads at the leading edge in FIG. 9). As a result, the potential on the transfer belt side of the printing paper decreases, and this is accompanied by a relative potential increase on the photoreceptor 23 side of the printing paper. This increases the attracting force between the printing paper and the photoreceptor 23, relative to that between the printing paper and the transfer belt 71. In this case, the printing paper will not be naturally stripped from the photoreceptor 23 and remains adhered to the surface of the photoreceptor 23. This necessitates the stripping claw 101 to forcibly strip the printing paper from the surface of the photoreceptor 23, with the result that toner contamination 104 occurs at the leading edge.

Figure 10:
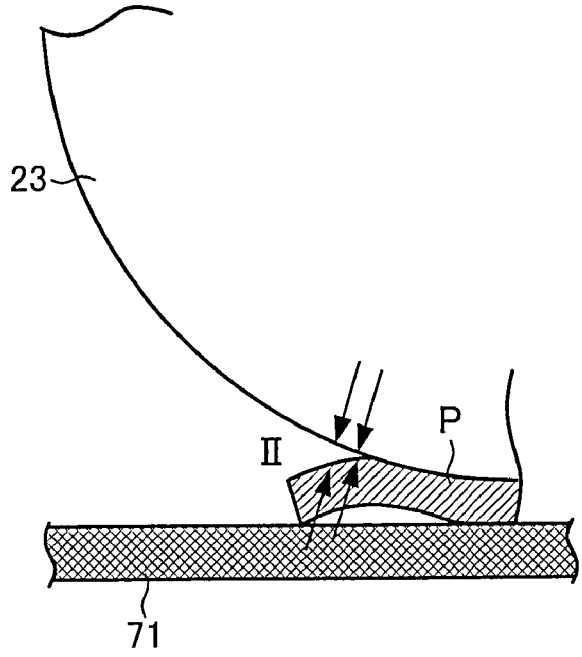
FIG. 10 is an explanatory diagram illustrating how the printing paper is stripped from the surface of the photoreceptor when the printing paper is transported with the projection of FIG. 8 not at the leading edge in the direction of transport of the printing paper.

FIG. 10 is an explanatory diagram showing how the printing paper is stripped from the surface of the photoreceptor 23, when the printing paper is transported in such a direction that the projection 114 is not present at the leading edge of the printing paper with respect to the direction of transport.

When the printing paper is transported in the direction shown in FIG. 10, no gap 117 is present between the leading edge of the printing paper and the transfer belt 71, and the lower surface of the printing paper will be in contact with the transfer belt 71. When the photoreceptor 23 rotates, this causes a continuous discharge according to Paschen's law between the leading edge of the printing paper and the photoreceptor 23 (between opposing arrowheads in FIG. 10). As a result, the printing paper is naturally stripped from the surface of the photoreceptor 23 by the rotation of the photoreceptor 23. There according will be no toner contamination 104 at the leading edge of the printing paper, which occurs when the printing paper is forcibly stripped by the striping claw 101.

Figure 11:
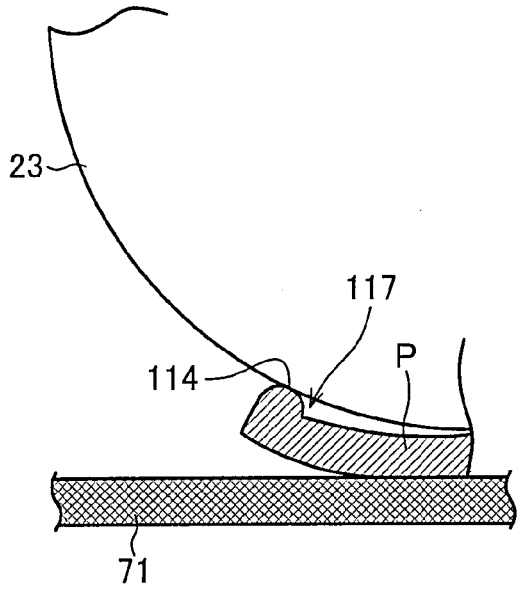
FIG. 11 is an explanatory diagram illustrating how the printing paper is stripped from the surface of the photoreceptor when the printing paper is transported with the projection of FIG. 8 at the leading edge in the direction of transport of the printing paper and facing the photoreceptor.

FIG. 11 is an explanatory diagram showing how the printing paper is stripped from the surface of the photoreceptor 23, when the printing paper is transported in such a direction that the projection 114 is at the leading edge of the printing paper with respect to the direction of transport and faces upward (faces the photoreceptor 23).

When the printing paper is transported in the direction shown in FIG. 11, the upper surface of the printing paper is separated from the photoreceptor 23 at the leading edge by the gap 117, which is created by the projection 114 at the leading edge of the printing paper. When the photoreceptor 23 rotates, this causes a continuous discharge according to Paschen's law between the leading edge of the printing paper and the transfer belt 71. As a result, the potential on the photoreceptor 23 side of the printing paper decreases, and this is accompanied by a relative potential increase on the transfer belt 71 side of the printing paper. This decreases the attracting force between the printing paper and the photoreceptor 23. There according will be no toner contamination 104 at the leading edge of the printing paper, which occurs when the printing paper is forcibly stripped by the striping claw 101. Note that, in this case, the natural stripping of the printing paper from the surface of the photoreceptor 23 occurs more easily compared with the case shown in FIG. 10, making it possible to more effectively preventing the toner contamination 104 at the leading edge of the printing paper.

It can be seen from the foregoing configurations that the toner contamination 104 at the leading edge of the printing paper caused by the projection at the cutting surface (edge) of the printing paper can be prevented by transporting the printing paper in the directions shown in FIGS. 10 and 11, that is, in such directions that the projection 114 is not present at the leading edge of the printing paper, or by transporting the printing paper in such a direction that the projection 114 is present at the leading edge of the printing paper with respect to the direction of transport of the printing paper and that the projection 114 faces the photoreceptor 23. In other words, the toner contamination 104 can be prevented by not transporting the printing paper in the direction of transport shown in FIG. 9, that is, by not transporting the printing paper in such a direction that the projection 114 is present at the leading edge of the printing paper with respect to the direction of transport, and that the projection 114 faces the transfer belt 71. In the following, the directions of transport that do not cause the toner contamination 104 will be referred to as "proper transport directions."

In the image forming apparatus 3 shown in FIG. 2, the printing paper can be transported in the proper transport direction by properly placing the printing papers in the paper feed cassette 41 of the paper feeding section 13 and the large-capacity paper feed cassette 42, taking into account the direction of the projection 114. Whether a side of the printing paper has the projection 114, or the direction of the projection 114 can be found by touching the side of printing paper with a finger. This is possible despite the small size of the projection 114.

Figure 12:
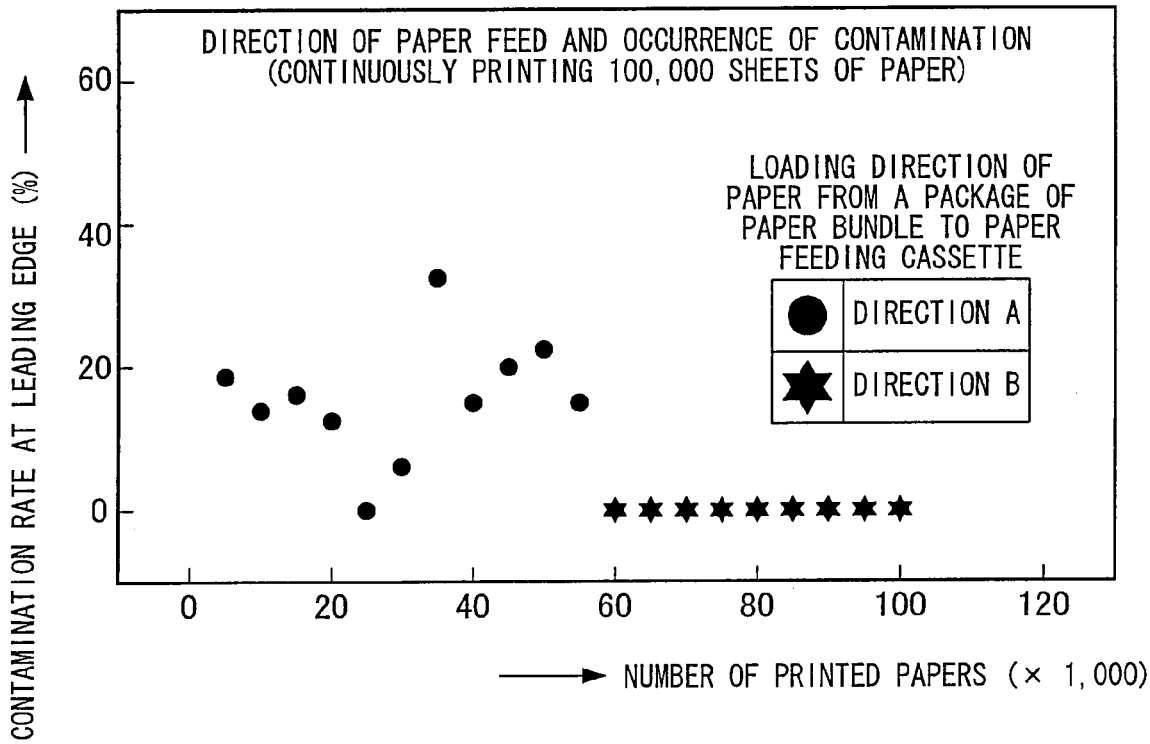
FIG. 12 is a graph representing a result of assessment on prevention of toner contamination on printing paper caused by the transport of printing paper in a proper transport direction according to the arrangement shown in FIG. 1.
Figure 13:
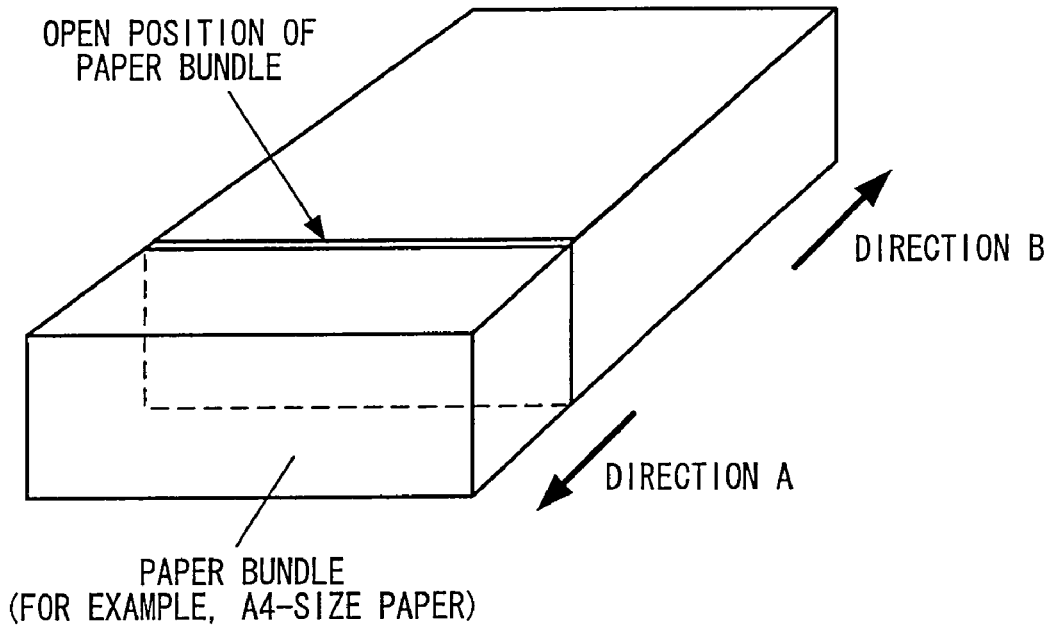
FIG. 13 is a perspective view showing an example of transport directions that are set for a package of printing paper.

The following describes results of assessment how the toner contamination 104 on the printing paper could be prevented by transporting the printing paper in the proper transport direction. In the assessment, a set of 60,000 printing papers was first transported without any consideration to the proper transport direction, and this was followed by a set of 40,000 printing papers in the proper transport direction. The results are shown in FIG. 12. Note that, the transport of printing paper in the proper transport direction refers to the transport without any presence of the projection 114 at the leading edge of printing paper in direction B shown in FIG. 13, when direction B is the direction of transport for example. The transport of printing paper in the proper transport direction also refers to the transport of printing paper that is placed in such a manner that the projection 114, which may be present partially or entirely at the leading edge of direction B, or at the leading edge of direction B or all four sides of the printing paper, is only on the side of the upper or lower surface of the printing paper and faces the photoreceptor 23. On the other hand, the transport of printing paper that does not take into account the proper transport direction refers to the transport of printing paper that has been placed without any consideration to the presence or absence of the projection 114 or the direction of the projection 114 at the leading edge with respect to direction A, when direction A is the direction of transport for example.

Figure 14:
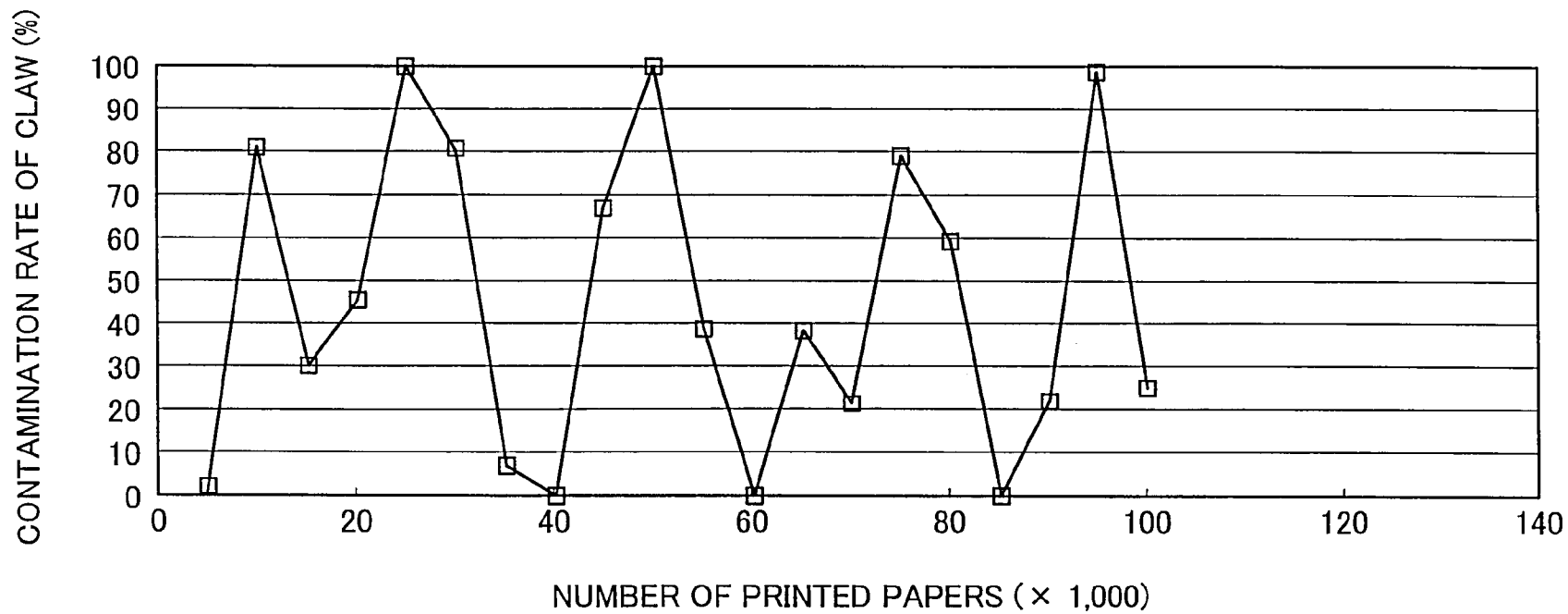
FIG. 14 is a graph representing a relation between the number of printed papers and the contamination rate of the striping claw shown in FIG. 1.

Along with the measurement concerning the prevention of the toner contamination 104 on the printing paper described with reference to FIG. 12, assessment was made concerning contamination of the stripping claw 101 that occurred during the printing of the same number of printing papers (10,000 sheets). The result is shown in FIG. 14. In this measurement, printing was performed by making white copies (no printed image), and was set such that all printing papers were forcibly stripped by the stripping claw 101. The stripping claw 101 was then examined in relation to the printing papers.

As can be seen from the result shown in FIG. 12, the toner contamination 104 occurred at the leading edge of the printing paper for the first 60,000 sheets that were transported without any consideration to the proper transport direction. For the next 40,000 sheets that were transported in the proper transport direction, no contamination 104 occurred at the leading edge of the printing papers.

It can be seen from the result shown in FIG. 14 that toner contamination occurred on the stripping claw 101 even in printing the 40,000 sheets of printing paper that were transported in the proper transport direction as described with reference to FIG. 12, i.e., 40,000 sheets of printing paper in which no toner contamination 104 occurred at the leading edge. It was found from this result that the toner contamination 104 at the leading edge of the printing paper could be reliably prevented even when the stripping claw 101 is contaminated. In FIG. 14, the contamination rate of the stripping claw 101 is the percentage of contaminated area on the stripping face of the stripping claw 101. The fluctuations in contamination rate of the stripping claw 101 are due to the toner falling off from the stripping face of the stripping claw 101 by the vibration of the stripping claw 101, and due to the continuously increasing amount of toner adhering to the stripping claw 101.

The following will describe the image forming apparatus 3 of the present embodiment in more detail in regard to the structure for preventing toner contamination at the leading edge of the printing paper.

In the present embodiment, the image forming apparatus 3 is adapted so that, when the printing papers replenishing the paper feed cassette 41 and the large-capacity paper feed cassette 42 are loaded improperly to be transported in the proper transport direction (when the projection 114 faces wrong directions with respect to the proper transport direction), the image forming apparatus 3 causes, for example, the touch-panel liquid crystal display (display means) 91 shown in FIG. 3 to perform display informing as such, so as to suggest changing the loading direction of printing paper for the proper transport of the printing paper in the proper transport direction.

Figure 15:
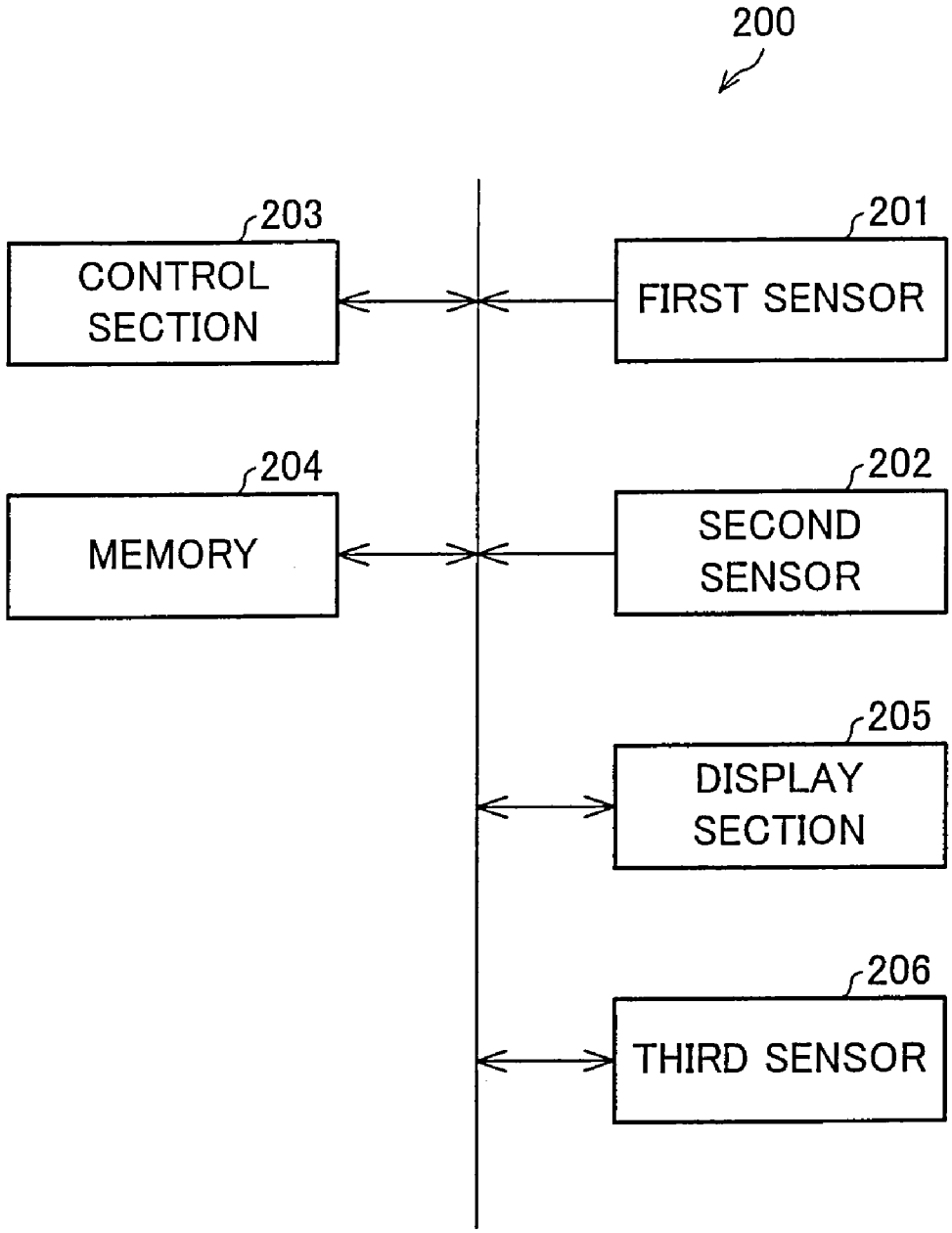
FIG. 15 is a block diagram showing a structure of a paper load direction error warning device provided in the image forming apparatus shown in FIG. 2.

To realize such functionality, the image forming apparatus 3 is provided with a sheet loading direction error warning device 200 as shown in FIG. 15. FIG. 15 is a block diagram showing a structure of the sheet loading direction error warning device 200. As shown in FIG. 15, the sheet loading direction error warning device 200 includes a first sensor (load height detecting means) 201, a second sensor (load height detecting means) 202, a control section (warning means, display control means, placement direction determining means, replenishing detecting means) 203, a third sensor (replenishing detecting means) 206, a memory 204, and a display section (warning means, display means) 205. The memory 204 is provided to store various kinds of data. The touch-panel liquid crystal display device 91 realizes the display section 205, for example.

Figure 16:
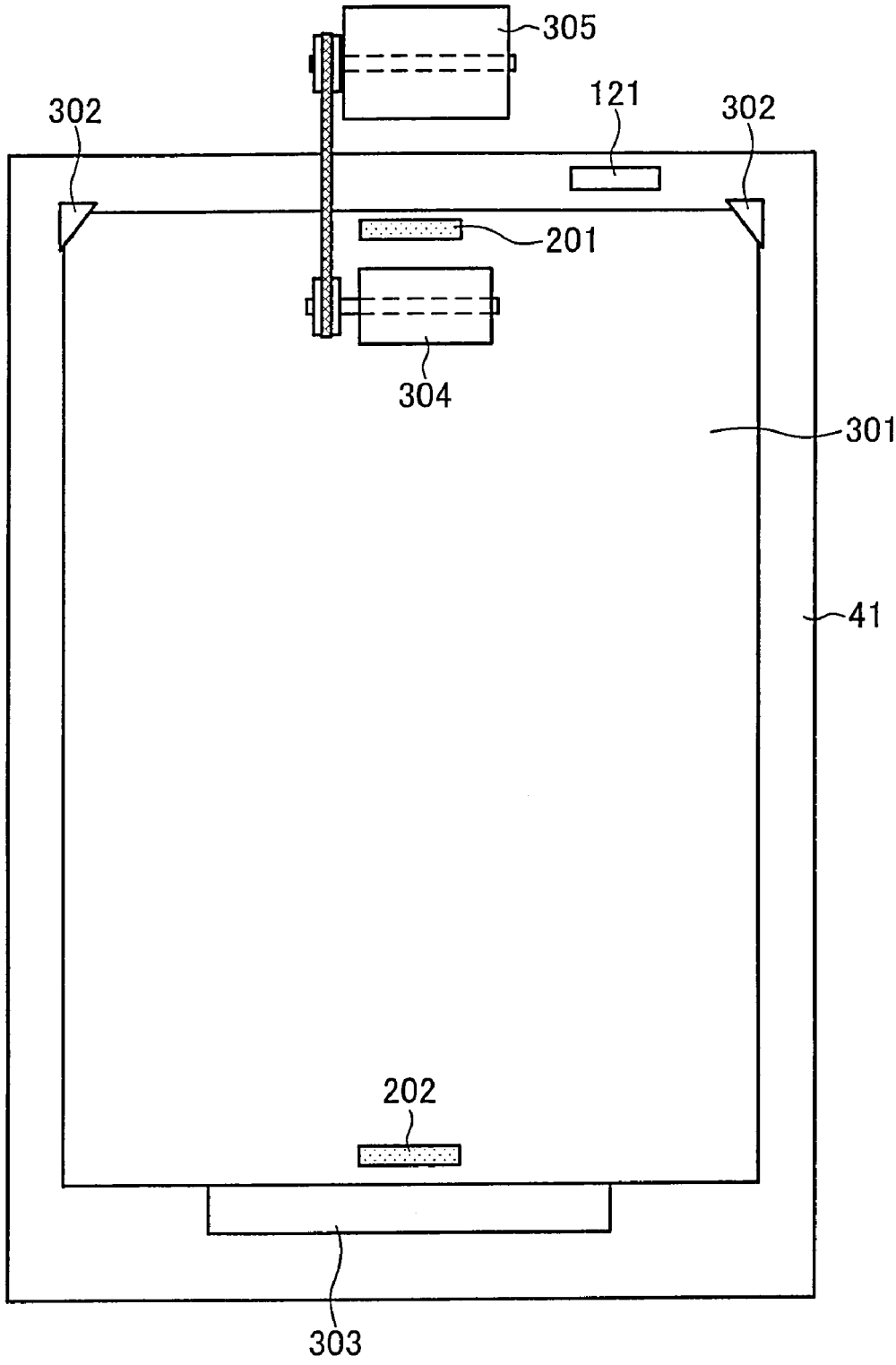
FIG. 16 is a plan view of a paper feed cassette provided in the image forming apparatus of FIG. 2, showing positions of first and second sensors in the structure shown in FIG. 15.
Figure 17:
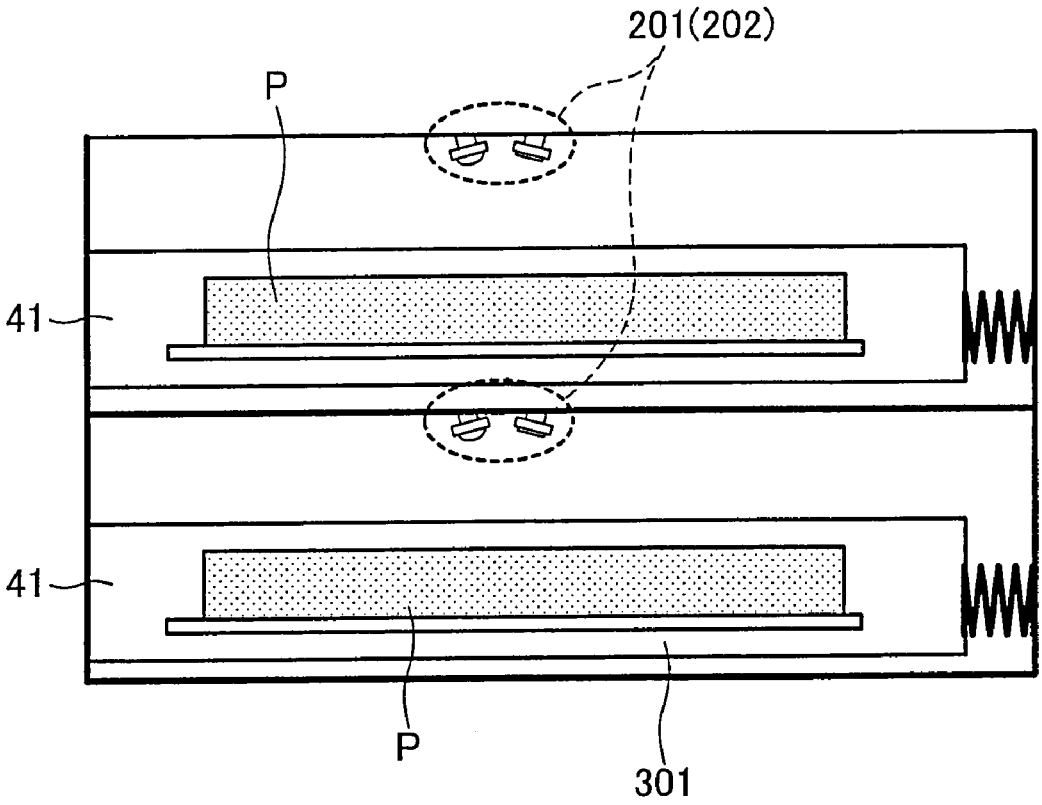
FIG. 17 is a longitudinal view schematizing upper and lower stages of the paper feed cassette shown in FIG. 16, showing positions of the first and second sensors in the structure shown in FIG. 15.

As shown in FIGS. 16 and 17, the first sensor 201 and the second sensor 202 are provided for each paper feed cassette 41. FIG. 16 is a plan view showing the paper feed cassette 41. FIG. 17 is a longitudinal section schematizing upper and lower stages of paper feed cassettes 41.

As shown in FIGS. 16 and 17, the first sensor 201 is disposed above a front end portion of the paper feed cassette 41 with respect to the paper eject direction. The second sensor 202 is disposed above a rear end portion of the paper feed cassette 41 with respect to the paper ejection direction. At their respective positions, the first and second sensors 201 and 202 detect a load height of the printing papers (position at the uppermost surface of printing paper) loaded in the paper feed cassette 41. The first sensor 201 and the second sensor 202 are realized by known structures, for example, such as a light-emitting element and a light-receiving element.

The paper feed cassette 41 shown in FIG. 16 includes a sheet loading table 301, a sheet front-end aligning member 302, and a sheet rear-end aligning plate 303. The sheet loading table 301 is provided at the bottom of the paper feed cassette 41. The sheet front-end aligning member 302 is provided on both sides at the front end of the paper feed cassette 41 with respect to the paper eject direction. The sheet rear-end aligning plate 303 is provided at the end portion of the paper feed cassette 41 with respect to the paper eject direction. Printing papers in the paper feed cassette 41 are picked up by a pick-up roller 304, and are sent out to the paper transport path 28 by a paper feed roller 305, which also serves as a separating roller.

The third sensor 206 detects that the paper feed cassettes 41 and 42 have been installed in the image forming apparatus 3. For example, the third sensor 206 is disposed at such a position that it can detect installation of the paper feed cassettes 41 and 42. Here, in a situation where the paper feed cassettes 41 and 42 are drawn out from the image forming apparatus 3 and the third sensor 206 detects the paper feed cassettes 41 and 42 that have been installed back to the predetermined original position, the control section 203 may find that replenishing of printing papers in the paper feed cassettes 41 and 42 have been finished, through a series of detection operations based on a detected signal from the third sensor 206.

Alternatively, the control section 203 may determine whether the paper feed cassette 41 has been replenished with the printing paper based on the result of detection of the first and second sensors 201 and 202, or the result of detection of the first sensor 201 or the second sensor 202.

In this manner, the control section 203 monitors whether the paper feed cassettes 41 and 42 have been replenished with printing papers by an operator (user). When it is determined that the printing paper has been supplied, the control section 203 calculates load heights at the front end portion and rear end portion of the replenished printing paper supplied to the paper feed cassette 41, based on the result of detection by the first and second sensors 201 and 202. From the relation of load heights at the front end and rear end portions, it is determined whether the projection 114 is present in which of the front end and rear end portions of the printing paper with respect to the paper eject direction.

Based on the result of determination, the control section 203 determines whether the printing paper can be sent out from the paper feed cassette 41 in the proper transport direction. If it is determined that the printing paper cannot be transported in the proper transport direction, the control section 203 causes the display section 205 to display as such. The display section 205 is also caused to perform display that suggests changing the loading direction of the printing paper for the transport in the proper transport direction. The display suggests changing the current placement direction of the printing paper to the proper placement direction.

The warning given out to the user when the current placement direction of the printing paper is not the proper placement direction is not limited to the display performed by the display section 205 but may be given in audio, for example.

In the following, description is made as to how the relation of the load heights at the front end and rear end portions of the printing papers in the paper eject direction loaded in the paper feed cassette 41 is used to determine whether the printing paper from the paper feed cassette 41 can be transported in the proper transport direction.

In the image forming apparatus 3 of the present embodiment, as shown in FIG. 2, the printing paper from the paper feed cassette 41 is transported between the photoreceptor 23 and the transfer belt 71 after it is flipped upside down through the paper transport path 28. Meanwhile, the printing paper from the large-capacity paper feed cassette 42 is transported between the photoreceptor 23 and the transfer belt 71 without flipping sides. In either case, the printing paper is transported between the photoreceptor 23 and the transfer belt 71 without reversing ends, regardless of whether it is transported from the paper feed cassette 41 or the paper feed cassette 42.

Thus, the printing paper can be transported in the proper transport direction when it is loaded in the paper feed cassettes 41 and 42 without having the projection 114 at the front end with respect to the paper eject direction. From the detected signal of the first and second sensors 201 and 202, the control section 203 can determine such a loading state as the state of printing paper that has been loaded to be properly transported in the proper transport direction.

When it is determined that the loading state of printing paper in the paper feed cassettes 41 and 42 would not allow transport in the proper transport direction, the control section 203 may cause the display section 205 to not only display information that suggests changing the loading direction of the printing paper to the direction that allows for transport in the proper transport direction but also display a loading state that allows the printing paper in each of the paper feed cassettes 41 and 42 to be transported in the proper transport direction. In this case, when the printing paper is loaded in such a direction that the projection 114 is at the leading edge of the printing paper in the paper eject direction, a proper direction (either up or down) of the projection 114 is indicated for each of the paper feed cassettes 41 and 42. Specifically, in the paper feed cassette 41, a proper loading state is the state in which the projection 114 at the leading edge in the paper eject direction faces downward. In the large-capacity paper feed cassette 42, a proper loading state is the state in which the projection 114 at the leading edge in the paper eject direction faces upward.

Figure 18:
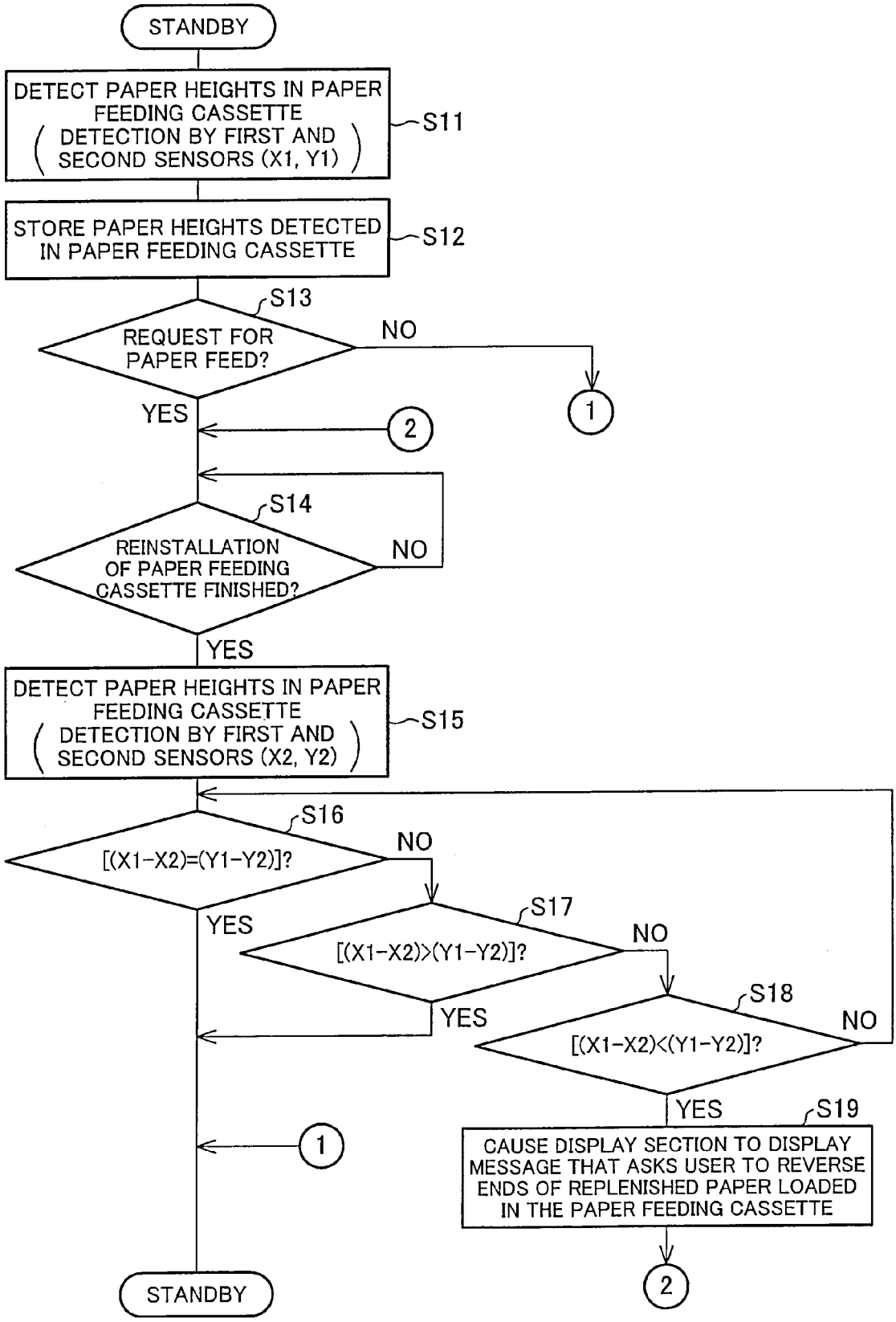
FIG. 18 is a flowchart representing operations of the paper load direction error warning device shown in FIG. 15.

According to the foregoing configuration, the following will describe operations of the sheet loading direction error warning device 200 with reference to a flowchart of FIG. 18.

Upon turning on a power switch for example, the control section 203 detects load heights (X1, Y1) of the printing paper loaded in the paper feed cassettes 41 and 42, based on the detected signals of the first and second sensors 201 and 202 (S11). Note that, X denotes the load height of the printing paper at the front end portion in the paper eject direction as detected by the first sensor 201, and Y denotes the load height of the printing paper at the rear end portion in the paper eject direction as detected by the second sensor 202. The load heights detected in each of the paper feed cassettes 41 and 42 are stored in the memory 204 (S12).

When the printing paper in the paper feed cassette 41 runs out for example, a request for paper feed in the paper feed cassette 41 is generated in response (S13). The request for paper feed is displayed in the display section 205, for example.

In response to the request for paper feed, an operator draws out the paper feed cassette 41 from the image forming apparatus 3, replenishes the paper feed cassette 41 with printing papers, and installs the paper feed cassette 41 back in the image forming apparatus 3. This is detected by the third sensor 206, which detects installation of the paper feed cassette (S14).

The control section 203 then detects load heights (X2, Y2) of the printing paper loaded in the paper feed cassette 41, based on the detected signals of the first and second sensors 201 and 202 (S15).

The control section 203 determines whether the relation (X1−X2)=(Y1−Y2) holds for the load heights (X1, Y1) of printing paper measured before replenishing the printing paper and stored in the memory 204, and the load heights (X2, Y2) of printing paper detected after replenishing (S16). This is to determine whether the relation between the load height (X) at the front end portion and the load height (Y) at the rear end portion of the printing paper in the paper eject direction has changed before and after replenishing the printing paper. If (X1−X2)=(Y1−Y2), it means that the relation between the load height (X) at the front end portion and the load height (Y) at the rear end portion of the printing paper in the paper eject direction in the paper feed cassette 41 remained the same. In this case, the loading state in the paper feed cassette 41 is determined as the state that allows for transport of the printing paper in the proper transport direction, and the process is finished.

On the other hand, if the result of determination in S16 is not (X1−X2)=(Y1−Y2), it is determined in S17 whether (X1−X2)>(Y1−Y2). This determines whether the load height (X) at the front end portion of printing paper has exceeded the load height (Y) at the rear end portion of printing paper in the paper feed cassette 41 after the printing paper was replenished. If (X1−X2)>(Y1−Y2), it means that the projection 114 is present at the rear end portion of the replenished printing paper, and that the load height (Y) at the read end portion of printing paper has exceeded the load height (X) at the front end portion of printing paper in the paper feed cassette 41. The loading state in the paper feed cassette 41 is therefore determined as the state that allows for transport of printing paper in the proper transport direction, and the process is finished.

If the result of determination in S17 is not (X1−X2)>(Y1−Y2), it is determined in S18 whether (X1−X2)<(Y1−Y2). This determines whether the load height (Y) at the rear end portion of printing paper has reduced below the load height (X) at the front end portion of printing paper in the paper feed cassette 41 after the printing paper was replenished. If (X1−X2)<(Y1−Y2), it means that the projection 114 is present at the front end portion of the replenished printing paper, and that the load height (Y) at the rear end portion of printing paper has reduced below the load height (X) at the front end portion of printing paper in the paper feed cassette 41 after the printing paper was replenished. The loading state in the paper feed cassette 41 is therefore determined as the state that does not allow for transport of printing paper in the proper transport direction, and the display section 205 performs display in S19.

In S19, the control section 203 causes the display section 205 to display a message that suggests the operator to change the loading direction, i.e., reverse the ends of the replenished printing paper with respect to the direction of transport (paper eject direction). The sequence then returns to S14 and the procedure is repeated.

According to the foregoing configuration, in a situation where the paper feed cassettes 41 and 42 are replenished with printing paper in the direction that does not allow the printing paper to be transported in the proper transport direction, the operator is notified as such and asked to changed the loading direction of the printing paper.

In this way, the printing paper from the paper feed cassettes 41 and 42 will not be transported between the photoreceptor 23 and the transfer belt 71 in directions other than the proper transport direction. There accordingly will be no contamination of the printing paper by the toner contamination 104, which is caused when the printing paper does not naturally strips off from the photoreceptor 23 but is forcibly stripped with the stripping claw 101 in contact with the leading edge of the printing paper.

In the foregoing embodiment, the printing papers may be wrapped with wrapping paper that is designated with an indication indicating the presence or absence of the projection 114 and the direction of the projection 114 on each edge of the printing paper.

Figure 19:
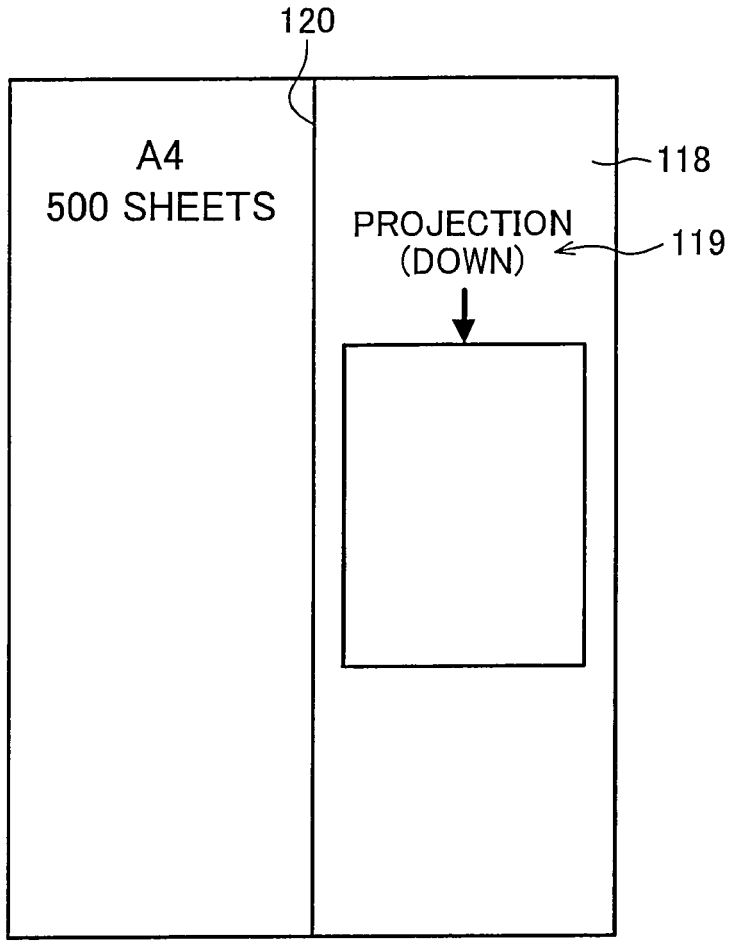
FIG. 19 is a front view illustrating a printing paper bundle packaged in units of 500 sheets for example, used in an embodiment of the present invention.

Such an arrangement is shown in FIG. 19. FIG. 19 is a front view showing a bundle of, for example, 500 sheets of printing paper. The printing papers are wrapped with a wrapping paper 118, which is designated with a making, i.e., a projection printed indication 119, indicating the position and direction of the projection 114 on the printing paper. The projection printed indication 119 indicates that the projection 114 is present on the position indicated by the arrow and is facing down. Indicated by 120 is an opening position.

According to this arrangement, the operator can refer to the projection printed indication 119 and place the printing paper on the paper feed cassettes 41 and 42 in such a direction that the printing paper is transported with the projection 114 not facing the surface of the transfer belt 71 at the leading edge of the printing paper being transported on the transfer belt 71.

Figure 20:
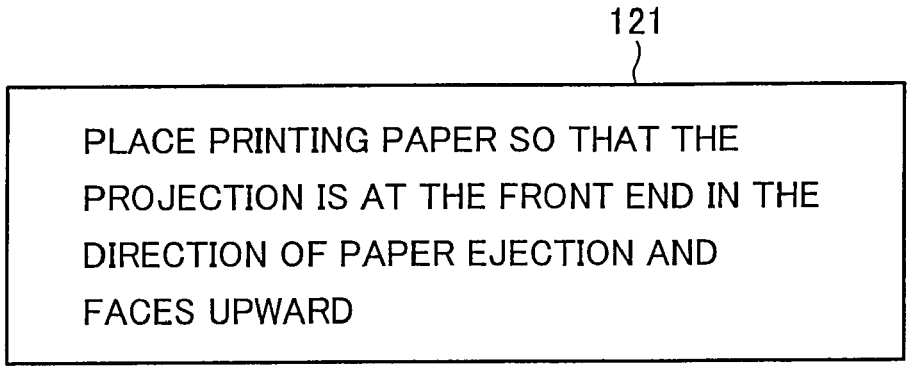
FIG. 20 is an explanatory diagram representing an indication marked on the paper feed cassette of FIG. 16 regarding a placement direction of printing paper.

Further, in the foregoing embodiment, the paper feed cassettes 41 and 42 may have an indication indicative of a placement direction of printing paper, in order to transport the printing paper in the proper transport direction. This arrangement is shown in FIGS. 16 and 20. FIG. 20 is an explanatory view showing a printing paper placement direction indication 121 marked on the paper feed cassette 41. As shown in FIG. 16, the printing paper placement direction indication 121 is marked on the paper feed cassette 41 to indicate a placement direction of printing paper, taking into account the position and direction of the projection 114 on the printing paper placed in the paper feed cassette 41. For example, as shown in FIG. 20, the printing paper placement direction indication 121 asks the operator to place the printing paper so that the projection is on the leading edge of the printing paper in the paper eject direction and faces upward.

According to this arrangement, by referring to the printing paper placement direction indication 121, the operator is able to place the printing paper in the paper feed cassettes 41 and 42 such that the printing paper is transported with the projection 114 not facing the surface of the transfer belt 71 at the leading edge of the printing paper being transported on the transfer belt 71.

Note that, in the present embodiment, the projection 114 of printing paper has such a height, ranging 3 μm to 8 μm, that it creates a gap between the projection 114 and the transfer belt and generates a discharge between the printing paper and the transfer belt. Further, as an example, the photoreceptor 23 has a diameter of 120 mm, and the printing paper on the transfer belt 71 is transported at a transport speed of 500 mm/sec to 650 mm/sec.

The present invention is applicable to arrangements in which the projection generated on the printing paper when it was cut may have adverse effects on a component such as the transfer section including a photoreceptor and a transfer belt in an image forming apparatus, so that the printing paper can be transported so as to avoid such adverse effects.

In the image forming method of the present invention, the printing paper may be transported in the proper transport direction so that the projection faces the surface of the photoreceptor at the leading edge of the printing paper being transported.

According to this arrangement, the printing paper is transported such that the projection faces the surface of the photoreceptor at the leading edge of the printing paper being transported. This creates a gap between the leading edge of the printing paper and the surface of the photoreceptor, and a continuous discharge occurs between the leading edge of the printing paper and the surface of the photoreceptor according to Paschen's law. As a result, the potential on the photoreceptor side of the printing paper decreases. This decreases the electrostatic attracting force between the printing paper and the photoreceptor. It is therefore ensured that the printing paper naturally strips from the surface of the photoreceptor, and there will be no toner contamination at the leading edge of the printing paper, which occurs when the leading edge of the printing paper is in contact with the stripping claw.

The image forming method may be adapted so that the projection is generated at one of the leading edge and an end portion of the printing paper with respect to the direction of transport, and that the printing paper is transported in the proper transport direction so that the projection is at the end portion of the printing paper being transported on the transport belt.

According to this arrangement, the printing paper is transported so that the projection is at the end portion of the printing paper being transported on the transport belt. Thus, the projection does not face the transport belt at the leading edge of the printing paper, and there accordingly will be no gap between the leading edge of the printing paper and the transport belt. There is therefore no potential drop on the transport belt side of the printing paper, and no relative increase in the attracting force between the printing paper and the photoreceptor. It is therefore ensured that the printing paper naturally strips from the surface of the photoreceptor, and there will be no toner contamination at the leading edge of the printing paper, which occurs when the leading edge of the printing paper is in contact with the stripping claw.

The image forming method may be adapted so that the printing paper is loaded in a paper feeding section and is sent out therefrom between the photoreceptor and the transport belt, and that the printing paper is placed on the paper feeding section such that the printing paper is transported in the proper transport direction on the transport belt.

According to this arrangement, in the image forming apparatus, the printing paper is placed on the paper feeding section such that the printing paper is transported with the projection not facing the surface of the transport belt at the leading edge of the printing paper being transported on the transport belt. It is therefore ensured that the printing paper naturally strips from the surface of the photoreceptor, and there will be no toner contamination at the leading edge of the printing paper, which occurs when the leading edge of the printing paper is in contact with the stripping claw.

The image forming method may be adapted so that whether the projection is present or absent on the printing paper, or the direction of the projection on the printing paper is recognizable with a finger.

According to this arrangement, an operator is able to confirm the presence or absence, and the direction of the projection on the printing paper, and then place the printing paper on the paper feeding section such that the printing paper is transported with the projection not facing the surface of the transport belt at the leading edge of the printing paper being transported on the transport belt. As a result, there will be no toner contamination at the leading edge of the printing paper, which occurs when the leading edge of the printing paper is in contact with the stripping claw.

The image forming method may be adapted so that a wrapping paper wrapping the printing paper in units of predetermined numbers of sheets is marked with an indication indicating whether the projection is present or absent, and a direction of the projection on edges of the printing paper.

According to this arrangement, an operator is able to confirm the presence or absence, and the direction of the projection on edges of the printing paper by referring to the indication marked on the wrapping paper wrapping the printing paper in units of predetermined numbers of sheets, and then place the printing paper on the paper feeding section such that the printing paper is transported with the projection not facing the surface of the transport belt at the leading edge of the printing paper being transported on the transport belt. As a result, there will be no toner contamination at the leading edge of the printing paper, which occurs when the leading edge of the printing paper is in contact with the stripping claw.

The image forming method may be adapted so that the printing paper is loaded and stored in the paper feeding section and is sent out therefrom between the photoreceptor and the transport belt, and that the paper feeding section is marked with an indication indicating a placement direction of the printing paper so that the printing paper is transported between the photoreceptor and the transport belt in the proper transport direction.

According to this arrangement, an operator is able to confirm the placement direction of the printing paper in the indication marked on the paper feeding section of the image forming apparatus, and then place the printing paper on the paper feeding section such that the printing paper is transported with the projection not facing the surface of the transport belt at the leading edge of the printing paper being transported on the transport belt. As a result, there will be no toner contamination at the leading edge of the printing paper, which occurs when the leading edge of the printing paper is in contact with the stripping claw.

The image forming apparatus may be adapted to further include replenishment detecting means for detecting that the paper feeding section has been replenished with the printing paper, wherein the load height detecting means, the placement direction determining means, and the warning means perform the respective operations when the replenishment detecting means detects that the paper feeding section has been replenished with the printing paper.

According to this arrangement, when the replenishment detecting means detects that the paper feeding section has been replenished with printing paper, the respective operations of the load height detecting means, the placement direction determining means, and the warning means are set off, and the warning means performs a warning operation. Thus, in the case where the current placement direction of the printing paper bundle does not match the proper placement direction at the time when the printing paper is replenished into the paper feeding section, a user of the apparatus can be appropriately warned as such.

The image forming apparatus may be adapted so that the warning means includes display means and display control means for controlling a display operation of the display means, wherein the display control means compares the proper placement direction with the current placement direction of the printing paper bundle loaded in the paper feeding section, and when the proper placement direction and the current placement direction do not match, causes the display means to perform display that facilitates the user of the image forming apparatus to change the current placement direction to the proper placement direction.

According to this arrangement, the operation panel of the image forming apparatus can be used as a display section where a warning is displayed.

The image forming apparatus may be adapted so that the proper placement direction is a direction that allows the printing paper to be transported such that the projection faces the surface of the photoreceptor at the leading edge of the printing paper being transported.

According to this arrangement, the printing paper sent from the paper feeding section is transported such that the projection faces the surface of the photoreceptor at the leading edge of the printing paper being transported. This creates a gap between the leading edge of the printing paper and the surface of the photoreceptor, and a continuous discharge occurs between the leading edge of the printing paper and the surface of the photoreceptor according to Paschen's law. As a result, the potential on the photoreceptor side of the printing paper decreases. This decreases the electrostatic attracting force between the printing paper and the photoreceptor. It is therefore ensured that the printing paper naturally strips from the surface of the photoreceptor, and there will be no toner contamination at the leading edge of the printing paper, which occurs when the leading edge of the printing paper is in contact with the stripping claw.

The image forming apparatus may be adapted so that the projection is generated on one of the leading edge and the rear end portion of the printing paper with respect to the direction of transport, and that the proper placement direction is a direction in which the printing paper is transported such that the projection is at the rear end portion of the printing paper being transported on the transport belt.

According to this arrangement, the printing paper sent from the paper feeding section is transported such that the projection is at the rear end portion of the printing paper being transported on the transport belt. Thus, the projection does not face the transport belt at the leading edge of the printing paper, and there accordingly will be no gap between the leading edge of the printing paper and the transport belt. There is therefore no potential drop on the transport belt side of the printing paper, and no relative increase in the attracting force between the printing paper and the photoreceptor. It is therefore ensured that the printing paper naturally strips from the surface of the photoreceptor, and there will be no toner contamination at the leading edge of the printing paper, which occurs when the leading edge of the printing paper is in contact with the stripping claw.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus in which an electrostatic latent image formed on a surface of a photoreceptor is developed into a developer image with a developer, and in which a printing paper sent out from a paper feeding section and transported on a transport belt is brought into contact with the surface of the photoreceptor to transfer the developer image onto the printing paper, said image forming apparatus comprising:

load height detecting means for detecting a height of a printing paper bundle loaded in the paper feeding section, both at a front end portion and a rear end portion with respect to a direction of ejection of the printing paper from the paper feeding section;

placement direction determining means for determining a current placement direction of the printing paper bundle from a result of detection of the load height detecting means, the current placement direction indicative of whether a projection generated in one direction on the printing paper as a result of cutting the printing paper in a printing paper manufacturing process is present on which of the front end portion and the rear end portion of the printing paper bundle with respect to the direction of ejection; and warning means for comparing the current placement direction with a proper placement direction, which is a direction set for the printing paper bundle in the paper feeding section so that the printing paper is transported with the projection not facing a surface of the transport belt at a leading edge of the printing paper being transported, and when the current placement direction and the proper placement direction do not match, giving a warning to a user of the image forming apparatus.

2. The image forming apparatus as set forth in claim 1, further comprising replenishment detecting means for detecting that the paper feeding section has been replenished with the printing paper, wherein the load height detecting means, the placement direction determining means, and the warning means perform the respective operations when the replenishment detecting means detects that the paper feeding section has been replenished with the printing paper.

3. The image forming apparatus as set forth in claim 1, wherein the warning means includes display means and display control means for controlling a display operation of the display means, wherein the display control means compares the proper placement direction with the current placement direction of the printing paper bundle loaded in the paper feeding section, and when the proper placement direction and the current placement direction do not match, causes the display means to perform display that facilitates the user of the image forming apparatus to change the current placement direction to the proper placement direction.

4. The image forming apparatus as set forth in claim 1, wherein the proper placement direction is a direction that allows the printing paper to be transported such that the projection faces the surface of the photoreceptor at the leading edge of the printing paper being transported.

5. The image forming apparatus as set forth in claim 1, wherein the projection is generated on one of the leading edge and the rear end portion of the printing paper with respect to the direction of transport, and wherein the proper placement direction is a direction in which the printing paper is transported such that the projection is at the rear end portion of the printing paper being transported on the transport belt.

6. The image forming apparatus as set forth in claim 3, wherein whether the projection is present or absent on the printing paper, or the direction of the projection on the printing paper is recognizable with a finger.

7. The image forming apparatus as set forth in claim 1, wherein the load height detecting means comprise a light emitting element and a light receiving element, which are provided above a front end portion and a rear end portion of the paper feeding section with respect to a direction of paper ejection, respectively.

8. The image forming apparatus as set forth in claim 2, wherein the replenishment detecting means detects whether the paper feeding section has been replenished with the printing paper, based on results of detection of the light emitting element and the light receiving element of the load height detecting means.

* * * * *